US012740680B2

(12) United States Patent
Jang et al.

(10) Patent No.: US 12,740,680 B2
(45) Date of Patent: Sep. 22, 2026

(54) DUST COLLECTOR, VACUUM CLEANER, AND CLEANING DEVICE

(71) Applicant: Samsung Electronics Co., Ltd., Suwon-si (KR)

(72) Inventors: Yunsoo Jang, Suwon-si (KR); Dokyung Lee, Suwon-si (KR); Kihwan Kwon, Suwon-si (KR); Seokman Hong, Suwon-si (KR)

(73) Assignee: SAMSUNG ELECTRONICS CO, LTD., Suwon-si (KR)

( * ) Notice: Subject to any disclaimer, the term of this patent is extended or adjusted under 35 U.S.C. 154(b) by 614 days.

(21) Appl. No.: 17/989,025

(22) Filed: Nov. 17, 2022

(65) Prior Publication Data

US 2023/0180982 A1 Jun. 15, 2023

Related U.S. Application Data

(63) Continuation of application No. PCT/KR2022/017053, filed on Nov. 2, 2022.

(30) Foreign Application Priority Data

Dec. 13, 2021 (KR) ..... 10-2021-0178027
Dec. 13, 2021 (KR) ..... 10-2021-0178028
Feb. 9, 2022 (KR) ..... 10-2022-0016971

(51) Int. Cl.
*A47L 9/10* (2006.01)
*A47L 9/16* (2006.01)
(Continued)

(52) U.S. Cl.
CPC ..... *A47L 9/106* (2013.01); *A47L 9/1633* (2013.01); *A47L 9/1675* (2013.01);
(Continued)

(58) Field of Classification Search
CPC ..... A47L 9/106; A47L 9/1633; A47L 9/1675; A47L 9/1683; A47L 9/1691;
(Continued)

(56) References Cited

U.S. PATENT DOCUMENTS 6,916,351 B2 7/2005 Oh
9,144,358 B2 9/2015 Smith
(Continued)

FOREIGN PATENT DOCUMENTS

CN 103040409 B 1/2016
EP 3 453 299 A1 3/2019
(Continued)

OTHER PUBLICATIONS

International Search Report, PCT/ISA/210, and Written Opinion, PCT/ISA/237, dated Feb. 14, 2023, in PCT/KR2022/017053.
(Continued)

*Primary Examiner* — Joel D Crandall
*Assistant Examiner* — Caleb Andrew Holizna
(74) *Attorney, Agent, or Firm* — STAAS & HALSEY LLP

(57) ABSTRACT

Provided is a dust collector of a vacuum cleaner, the dust collector including a dust collecting casing including an air inlet, an air outlet, and a foreign substance discharge port, a cyclone module configured to separate foreign substances by inducing a swirling flow of air drawn in via the air inlet, and a discharge door switchable between an open position in which the foreign substance discharge port is opened and a closed position in which the foreign substance discharge port is closed, wherein the cyclone module includes a fixed part and a rotating part having a rotating state in which it is allowed to rotate with respect to the fixed part when the discharge door is in the open position and a locked state in
(Continued)

which it is prevented from rotating with respect to the fixed part when the discharge door is in the closed position.

20 Claims, 33 Drawing Sheets

(51) Int. Cl.
*A47L 9/28* (2006.01)
*A47L 9/32* (2006.01)

(52) U.S. Cl.
CPC ..... *A47L 9/1683* (2013.01); *A47L 9/1691* (2013.01); *A47L 9/2857* (2013.01); *A47L 9/322* (2013.01)

(58) Field of Classification Search
CPC ..... A47L 9/2857; A47L 9/322; A47L 9/1608; A47L 9/1658; A47L 9/20; A47L 9/0063; A47L 9/0009; B01D 46/0056
USPC ..... 15/344
See application file for complete search history.

(56) References Cited

U.S. PATENT DOCUMENTS

| | | | | |
|---|---|---|---|---|
| 10,214,349 | B2 | 2/2019 | Conrad | |
| 10,537,220 | B2 | 1/2020 | Cho et al. | |
| 10,835,093 | B2 | 11/2020 | Kim et al. | |
| 10,856,711 | B2 | 12/2020 | Hyun et al. | |
| 10,898,045 | B2 | 1/2021 | Woo et al. | |
| 11,484,168 | B2 | 11/2022 | Cho et al. | |
| 2001/0025395 | A1* | 10/2001 | Matsumoto | A47L 9/1683 55/447 |
| 2007/0084160 | A1 | 4/2007 | Kim | |
| 2016/0088988 | A1 | 3/2016 | Eo et al. | |
| 2020/0069128 | A1 | 3/2020 | Cho et al. | |
| 2021/0161344 | A1 | 6/2021 | Ryu et al. | |
| 2021/0307578 | A1* | 10/2021 | Hwang | A47L 9/165 |
| 2023/0148812 | A1* | 5/2023 | Yang | B65F 1/06 15/347 |

FOREIGN PATENT DOCUMENTS

| | | | |
|---|---|---|---|
| JP | 2010-94438 | | 4/2010 |
| JP | 2014-76141 | | 5/2014 |
| JP | 2017000580 | A * | 1/2017 |
| JP | 2019-155053 | | 9/2019 |
| JP | 6581400 | | 9/2019 |
| JP | 6648618 | | 2/2020 |
| KR | 10-0437106 | | 6/2004 |
| KR | 10-0725514 | | 6/2007 |
| KR | 10-1622726 | | 5/2016 |
| KR | 10-1653481 | | 9/2016 |
| KR | 10-2016-0138813 | | 12/2016 |
| KR | 10-1842464 | | 3/2018 |
| KR | 10-2018-0068204 | | 6/2018 |
| KR | 10-2015092 | | 10/2019 |
| KR | 10-2101701 | | 4/2020 |
| KR | 10-2185964 | | 12/2020 |
| KR | 10-2021-0002057 | | 1/2021 |
| KR | 10-2021-0058786 | | 5/2021 |
| KR | 10-2021-0067638 | | 6/2021 |
| KR | 10-2306705 | | 9/2021 |
| KR | 10-2308661 | | 10/2021 |

OTHER PUBLICATIONS

European Search Report dated Apr. 14, 2025, in European Application No. EP 22 90 7696.

* cited by examiner

DUST COLLECTOR, VACUUM CLEANER, AND CLEANING DEVICE

CROSS REFERENCE TO RELATED APPLICATIONS

This application is a continuation application of International Application No. PCT/KR2022/017053, filed on Nov. 2, 2022, and claims priority to Korean Patent Application No. 10-2021-0178027, filed on Dec. 13, 2021; Korean Patent Application No. 10-2021-0178028; filed on Dec. 13, 2021, and Korean patent Application No. 10-2022-0016971, filed Feb. 9, 2022, the disclosures of which are incorporated by reference herein in their entireties.

BACKGROUND

1. Field

Embodiments of the disclosure provide a dust collector, a vacuum cleaner including the same, and a cleaning device including the vacuum cleaner.

2. Description of Related Art

A vacuum cleaner is an electronic product that uses sound pressure to suck up air containing foreign substances such as dirt, dust, etc., and then filters out the foreign substances from the inside of a main body of the vacuum cleaner. Such a vacuum cleaner includes a dust collector that separates the foreign substances from the sucked air to collect the foreign substances and then discharges purified air to the outside.

As an example of the dust collector, a cyclone dust collector separates foreign substances, such as dirt, dust, etc., from sucked air by using a centrifugal force. The cyclone dust collector may include a dust collecting casing and a cyclone module for forming a cyclone within the dust collecting casing.

The separated foreign substances are collected in the dust collecting casing, and the collected foreign substances need to be periodically removed. However, when a user directly removes the foreign substances from the dust collector, dirt and dust may be redispersed in the atmosphere, and thus, indoor dust concentration may be increased.

To reduce the user's inconvenience of directly removing foreign substances, a cleaner station for automatically discharging foreign substances collected in the dust collector may be considered.

However, even when such a cleaner station is used, some foreign substances, such as hair, may remain in the dust collector without being discharged therefrom. In this case, an operation to be carried out by the user to remove the residual foreign substances is eventually required, which may lead to user's inconvenience.

SUMMARY

Aspects of embodiments of the disclosure will be set forth in part in the description which follows and, in part, will be apparent from the description, or may be learned by practice of the embodiments.

According to an embodiment of the disclosure, a dust collector may include: a dust collecting casing including an air inlet, an air outlet, and a foreign substance discharge port; a cyclone module inside the dust collecting casing, wherein the dust collecting casing and the cyclone module are configured so that air and foreign substances are drawn into the dust collecting casing through the air inlet, the foreign substances drawn into the dust collecting casing are separated from the air drawn into the dust collecting casing by the cyclone module, the separated foreign substances are dischargeable from the dust collecting casing through the foreign substance discharge port, and the air from which the foreign substances are separated is expelled through the air outlet; and a discharge door configured to be switchable between an open position in which the foreign substance discharge port is opened and a closed position in which the foreign substance discharge port is closed, wherein the cyclone module may include: a fixed part fixed to the dust collecting casing, and a rotating part configured to have a rotating state in which the rotating part is rotatable with respect to the fixed part via air flow generated in the dust collecting casing when the discharge door is in the open position to discharge foreign substances in the dust collecting casing through the foreign substance discharge port, and a locked state in which the rotating part is prevented from rotating with respect to the fixed part when the discharge door is in the closed position.

According to an embodiment of the disclosure, when the discharge door is switched from the closed position to the open position, the rotating part moves downward to be switched from the locked state to the rotating state, and, when the discharge door is switched from the open position to the closed position, the rotating part moves upward to be switched from the rotating state to the locked state.

According to an embodiment of the disclosure, the dust collector may further include a rotation preventing member configured to provide, when the rotating part is in the locked state, a rotational friction force between the rotating part and the fixed part so as to prevent the rotating part from rotating with respect to the fixed part.

According to an embodiment of the disclosure, the rotation preventing member is elastically deformable and includes an elastic member on at least one of the rotating part or the fixed part.

According to an embodiment of the disclosure, when the discharge door is in the closed position, the discharge door contacts and presses the rotating part, and the rotation preventing member is compressively deformed by the rotating part.

According to an embodiment of the disclosure, when the discharge door is in the open position, the discharge door is spaced apart from the rotating part, compressive deformation of the rotation preventing member by the rotating part is released, and the rotating part is rotatable with respect to the fixed part.

According to an embodiment of the disclosure, when the discharge door is in the open position, airflows are introduceable into the dust collecting casing via the air inlet and the air outlet, and the separated foreign substances are dischargeable through the foreign substance discharge port, and the rotating part includes a rotation guide unit configured to receive a rotational force due to the airflows introduced via the air inlet and the air outlet.

According to an embodiment of the disclosure, the rotation guide unit includes a first rotation guide member on an outer circumferential surface of the rotating part to receive a rotational force due to the airflows introduced through the air inlet.

According to an embodiment of the disclosure, the rotation guide unit further includes a second rotation guide member at an inner circumferential surface of the rotating part to receive a rotational force due to the airflows introduced via the air outlet.

According to an embodiment of the disclosure, the fixed part includes a cyclone body, and a mounting member supporting the cyclone body and mounted on the dust collecting casing, and the rotating part includes an inner casing having a cylindrical shape surrounding the cyclone body and including a mesh filter and a dust separation member assembled to the inner casing and having a dust collecting chamber in which the separated foreign substances are collected.

According to an embodiment of the disclosure, the dust separation member includes a dust storage forming the dust collecting chamber and a support wall surrounding and supporting the dust storage, and the first rotation guide member includes a plurality of first outer blades on an outer circumferential surface of the support wall.

According to an embodiment of the disclosure, an outer diameter formed by the plurality of first outer blades is less than or equal to an outer diameter of the mesh filter.

According to an embodiment of the disclosure, the first rotation guide member further includes a plurality of second outer blades on an outer circumferential surface of the dust storage, and an outer diameter formed by the plurality of second outer blades is less than or equal to the outer diameter formed by the plurality of first outer blades.

According to an embodiment of the disclosure, the second rotation guide member includes an inner blade at an inner circumferential surface of the dust separation member.

According to an embodiment of the disclosure, the cyclone module includes at least one bearing structure configured to rotatably support the rotating part with respect to the fixed part, and the at least one bearing structure is at a center of rotation of the inner blade.

According to an embodiment of the disclosure, the cyclone module further includes a pressure member configured to press the rotating part so that the rotating part is switched from the locked state to the rotating state.

According to an embodiment of the disclosure, the fixed part includes a stopper configured to limit a position to which the rotating part is permitted to move downward.

According to an embodiment of the disclosure, a vacuum cleaner may include the dust collector of embodiments of the disclosure.

According to an embodiment of the disclosure, a cleaning device includes a vacuum cleaner including: a dust collecting casing including an air inlet, an air outlet, and a foreign substance discharge port, a cyclone module inside the dust collecting casing, wherein the dust collecting casing and the cyclone module are configured so that air and foreign substances are drawn into the dust collecting casing through the air inlet, the foreign substances drawn into the dust collecting casing are separated from the air drawn into the dust collecting casing by the cyclone module, the separated foreign substances are dischargeable from the dust collecting casing through the foreign substance discharge port, and the air from which the foreign substances are separated is expelled through the air outlet, and a discharge door configured to be switchable between an open position in which the foreign substance discharge port is opened and a closed position in which the foreign substance discharge port is closed, wherein the cyclone module includes: a fixed part fixed to the dust collecting casing, and a rotating part configured to have a rotating state in which the rotating part is rotatable with respect to the fixed part via air flow generated in the dust collecting casing when the discharge door is in the open position to discharge foreign substances in the dust collecting casing through the foreign substance discharge port, and a locked state in which the rotating part is prevented from rotating with respect to the fixed part when the discharge door is in the closed position; and a cleaner station including a docking part to which the vacuum cleaner is connectable, a suction unit configured to provide a suction force to generate the air flow in the dust collecting casing to rotate the rotating part when the vacuum cleaner is connected to the docking part, the discharge door is in the open position, and the rotating part is in the rotating state, so that foreign substances in the dust collecting casing are discharged through the foreign substance discharge port to the cleaning station, and a collector configured to collect the foreign substances discharged to the cleaning station.

According to an embodiment of the disclosure, the suction unit is configured to provide the suction force so that the rotating part rotates at a speed greater than or equal to 300 revolutions per minute (rpm) but less than or equal to 10,000 rpm.

BRIEF DESCRIPTION OF DRAWINGS

The above and other aspects, features, and advantages of embodiments of the disclosure will be more apparent from the following description taken in conjunction with the accompanying drawings, in which.

DETAILED DESCRIPTION

Figure 1:
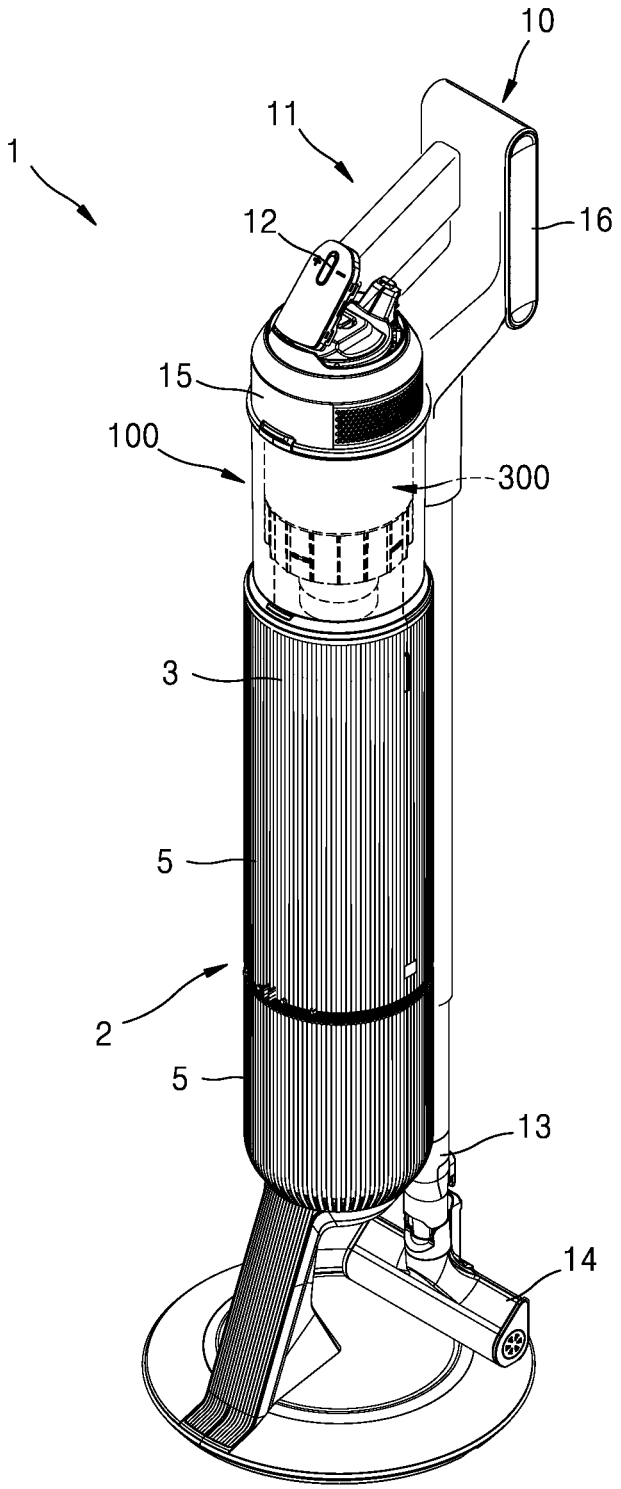
FIG. 1 illustrates a cleaning device according to an embodiment of the disclosure.

Throughout the disclosure, the expression "at least one of a, b or c" indicates only a, only b, only c, both a and b, both a and c, both b and c, all of a, b, and c, or variations thereof.

Embodiments of the disclosure will be described more fully with reference to the accompanying drawings. In the drawings, like reference numerals or symbols refer to like components or elements performing substantially the same functions.

It will be understood that, although the terms including an ordinal number such as "first", "second", etc. may be used herein to describe various elements or components, these elements or components should not be limited by the terms. The terms are only used to distinguish one element or component from another element or component. For example, as used herein, a first element or component may be termed a second element or component without departing from the scope of the disclosure, and similarly, a second element or component may be termed a first element or component. As used herein, the term "and/or" includes any and all combinations of one or more of the associated listed items.

The terms used herein are for the purpose of describing an embodiment of the disclosure and is not intended to limit the disclosure. As used herein, singular forms are intended to include the plural forms as well, unless the context clearly indicates otherwise.

It will be further understood that the terms "comprises" and/or "includes" when used in this specification, specify the presence of stated features, integers, steps, operations, elements, components, or combinations thereof, but do not preclude the presence or addition of one or more other features, integers, steps, operations, elements, components, or combinations thereof. In the drawings, like reference numerals represent like elements performing substantially the same functions.

The present application may provide a dust collector capable of minimizing the amount of foreign substances remaining in the dust collector, a vacuum cleaner including the dust collector, and a cleaning device including the vacuum cleaner.

Figure 2:
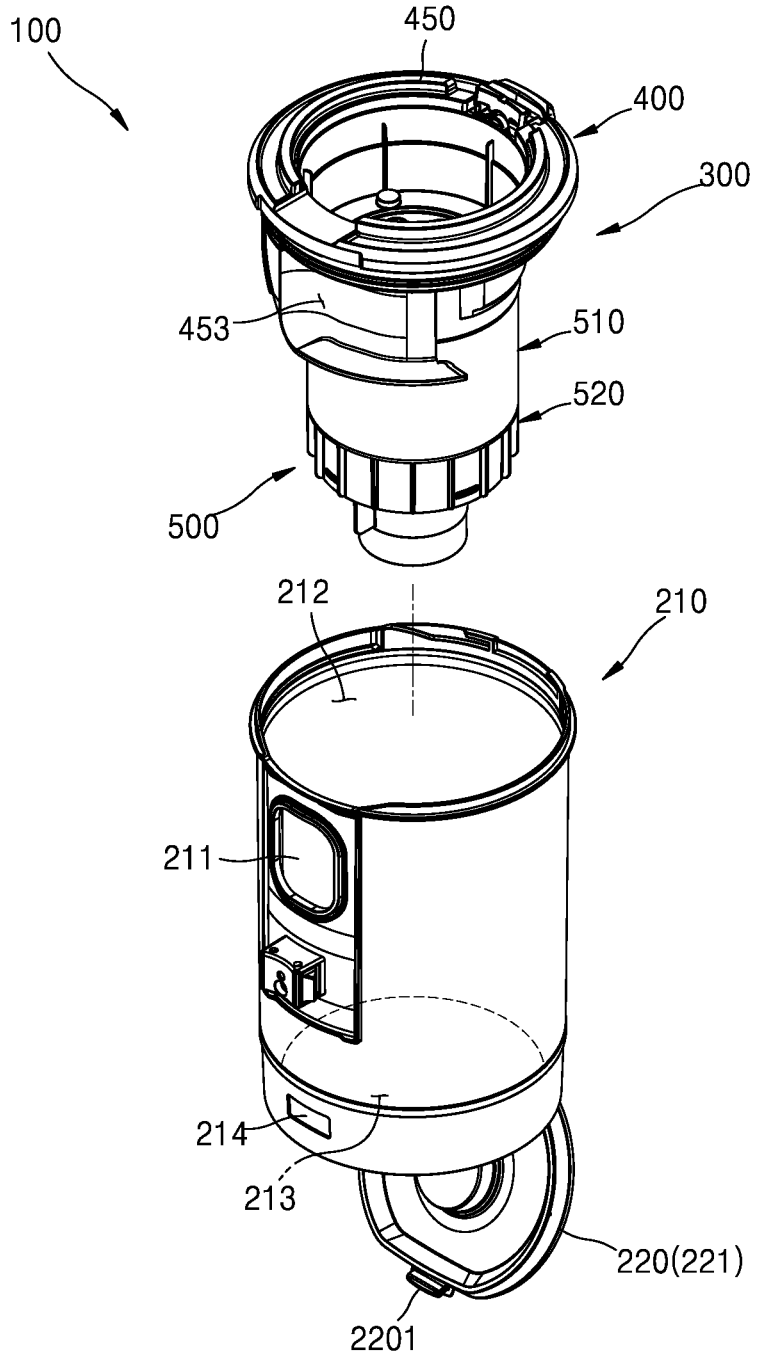
FIG. 2 is an exploded perspective view of a dust collector of a vacuum cleaner, according to an embodiment of the disclosure.
Figure 3:
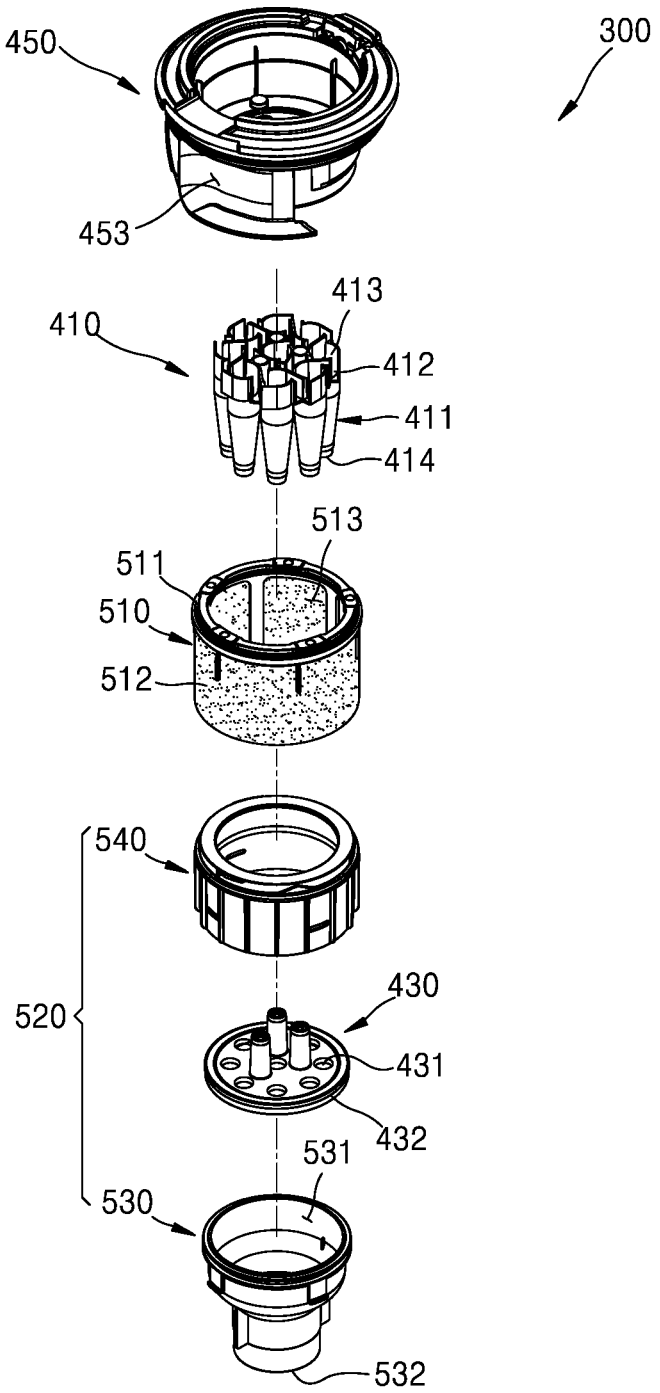
FIG. 3 is an exploded perspective view of a cyclone module of a dust collector, according to an embodiment of the disclosure.
Figure 4:
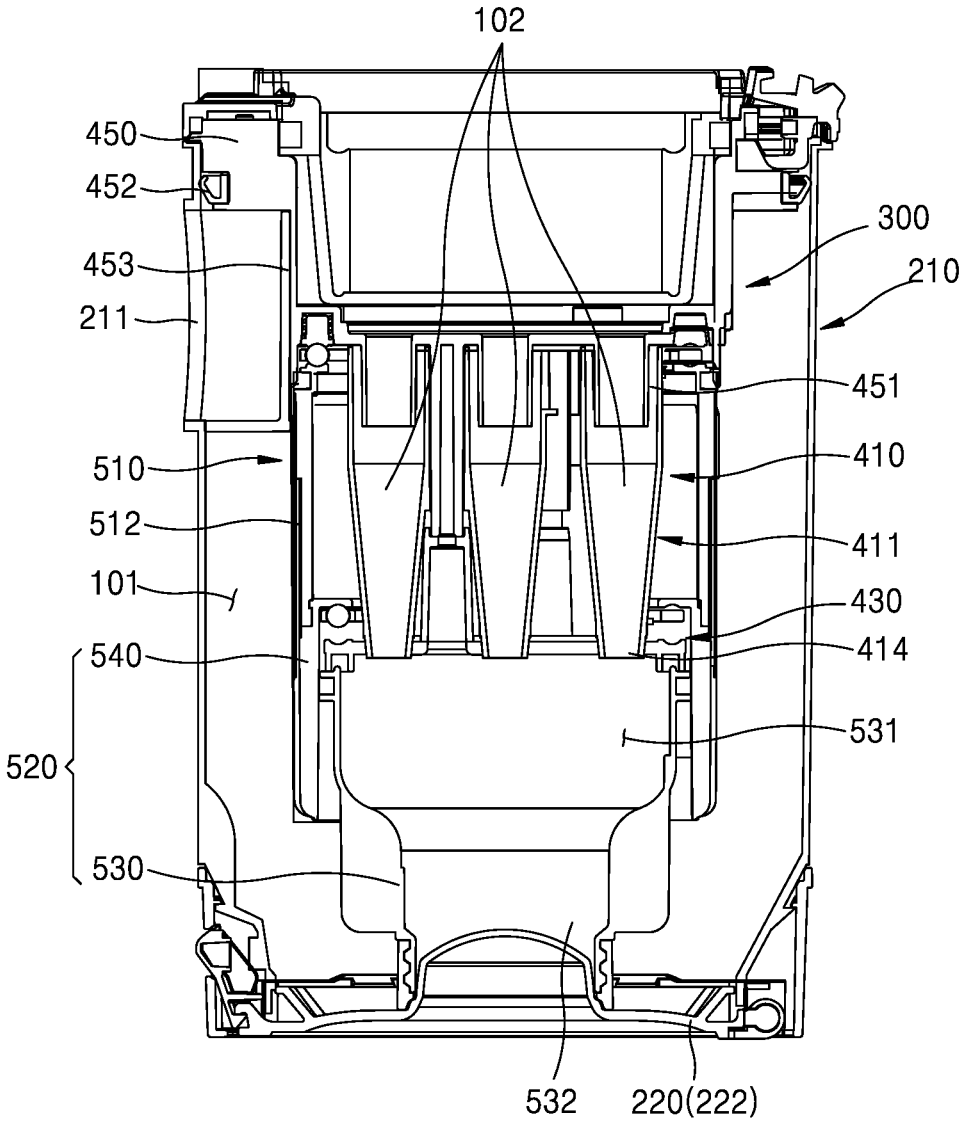
FIG. 4 is a cross-sectional view of a dust collector according to an embodiment of the disclosure.

FIG. 1 illustrates a cleaning device 1 according to an embodiment of the disclosure. FIG. 2 is an exploded perspective view of a dust collector 100 of a vacuum cleaner 10, according to an embodiment of the disclosure. FIG. 3 is an exploded perspective view of a cyclone module 300 of the dust collector 100, according to an embodiment of the disclosure. FIG. 4 is a cross-sectional view of the dust collector 100 according to an embodiment of the disclosure.

Referring to FIG. 1, the cleaning device 1 may include a vacuum cleaner 10 including the dust collector 100 and a cleaner station 2 connected to the dust collector 100 to suck in foreign substances accumulated in the dust collector 100 and remove the foreign substances from the dust collector 100.

The vacuum cleaner 10 may include a main body 11, a suction pipe 13 detachably coupled to the main body 11, a cleaner head 14 detachably coupled to the suction pipe 13, and the dust collector 100 detachably coupled to the main body 11. Foreign substances such as dust, hair, or the like in the air drawn through the cleaner head 14 may be collected in the dust collector 100.

The vacuum cleaner 10 may include a filter housing 15. A filter may be provided in the filter housing 15. The type of a filter to be used is not limited, but a high-efficiency particulate air (HEPA) filter may be used as an example. The filter may filter out ultrafine dust and the like that are not filtered out by the dust collector 100. The filter housing 15 may include an outlet so that air passing through the filter is expelled out of the vacuum cleaner 10. The vacuum cleaner 10 may include a handle held in a user's hand to manipulate the vacuum cleaner 10.

The main body 11 may include a battery 16 for providing a driving force to the vacuum cleaner 10. The battery 16 may be detachably mounted to the main body 11. The main body 11 may include a manipulating part 12. The user may turn on/off the vacuum cleaner 10 or adjust a suction strength by manipulating a power button and the like provided on the manipulating part 12.

According to an embodiment of the disclosure, the cleaner station 2 may include a docking part 3 provided to be connected to the dust collector 100 of the vacuum cleaner 10. The dust collector 100 may be mounted on the docking part 3 of the cleaner station 2 while not being separated from the vacuum cleaner 10. However, the state of the dust collector 100 connected to the docking part 3 is not limited thereto, and only the dust collector 100 may be separated from the vacuum cleaner 10 and docked onto the docking part 3.

The cleaner station 2 may include an inputter (not shown) capable of receiving an input from the user. The inputter may be configured as a button, a switch, etc. However, a location and a type of an inputter are not limited thereto as long as the inputter is able to receive a user input.

When the dust collector 100 is connected to the docking part 3, the cleaner station 2 may be provided to automatically discharge foreign substances collected in the dust collector 100 by changing a suction airflow supplied to the dust collector 100.

Referring to FIG. 2, according to an embodiment of the disclosure, the dust collector 100 may include a dust collecting casing 210, a discharge door 220, and a cyclone module 300.

The dust collecting casing 210 may be provided with an air inlet 211 and an air outlet 212. The air inlet 211 may be provided in a side of the dust collecting casing 210, and the air outlet 212 may be provided at a top portion of the dust collecting casing 210. The dust collecting casing 210 may have a hollow cylindrical shape and may include a foreign substance discharge port 213 provided at a bottom portion thereof for discharging dust. However, arrangement of the air inlet 211, the air outlet 212, and the foreign substance discharge port 213 in the dust collecting casing 210 is not limited thereto, and may be variously modified.

The discharge door 220 is provided at a bottom of the dust collecting casing 210 and opens and closes the foreign substance discharge port 213. The discharge door 220 is movable between an open position 221 for opening the foreign substance discharge port 213 and a closed position 222 (See FIG. 8) for closing the foreign substance discharge port 213. The dust collecting casing 210 may include a door lock member 214 configured to maintain the discharge door 220 in the closed position 222. The door lock member 214 supports an end 2201 of the discharge door 220 so that the discharge door 220 is maintained in the closed position 222. When the door lock member 214 is pressed by an external force, the door lock member 214 may be decoupled from the end 2201 of the discharge door 220, and the discharge door 220 may be switched or changed from the closed position 222 to the open position 221.

When the discharge door 220 is in the closed position 222, a top surface of the discharge door 220 forms a bottom surface of the dust collecting casing 210.

The cyclone module 300 is provided inside the dust collecting casing 210. The cyclone module 300 is inserted into the dust collecting casing 210 via the air outlet 212. The cyclone module 300 induces a swirling flow of the air drawn in through the air inlet 211.

Referring to FIGS. 2 through 4, the dust collector 100 may form multiple cyclones. For example, the cyclone module 300 of the dust collector 100 may form a first cyclone 101 between the cyclone module 300 and the dust collecting casing 210 to primarily (or firstly) separate foreign substances from the air drawn in through the air inlet 211 and form second cyclones 102 that secondarily separate foreign substances from the air from which the foreign substances are primarily separated by the first cyclone 101 and expel the resulting air through the air outlet 212.

The cyclone module 300 may include an inner casing 510, a cyclone body 410 provided inside the inner casing 510, a dust separation member 520 provided below the inner casing 510, and a mounting member 450 provided on the inner casing 510.

The inner casing 510 is provided inside the dust collecting casing 210 and is spaced apart from an inner circumferential surface of the dust collecting casing 210. The inner casing 510 includes a cyclone barrier 511 having a cylindrical shape and surrounding the cyclone body 410.

The cyclone barrier 511 includes a mesh filter 512 configured to allow the air to move toward the cyclone body 410. Like a grille, a filter, etc., the mesh filter 512 includes a plurality of holes to allow air to pass therethrough while preventing large foreign substances from passing therethrough. The mesh filter 512 may function as an outlet for expelling the air from which the foreign substances are removed by the first cyclone 101.

The inner casing 510 may function as a boundary for separating the first cyclone 101 from the second cyclones 102, and an interior space of the inner casing 510 may form an intermediate chamber 513 in which the air discharged from the first cyclone 101 via the mesh filter 512 is collected. The cyclone body 410 may be provided in the intermediate chamber 513. The cyclone body 410 may include a plurality of cyclone units 411 respectively forming the second cyclones 102. The cyclone body 410 may have a structure in which the plurality of cyclone units 411 are integrally formed.

Each of the plurality of cyclone units 411 may include an air inlet 412, an air outlet 413, and a foreign substance outlet 414. The plurality of cyclone units 411 may be provided along a circumferential direction. However, this is merely an example, and arrangement and the number of the plurality of cyclone units 411 may be variously modified. For example, the number of the plurality of cyclone units 411 may vary, and shapes of the air inlet 412, the air outlet 413, and the foreign substance outlet 414 may vary.

A lower plate 430 may be installed below the plurality of cyclone units 411. The lower plate 430 may be a circular plate. The lower plate 430 is provided for separation between a dust collecting chamber 531 of the dust separation member 520 and the intermediate chamber 513 in which the cyclone body 410 is installed. The lower plate 430 may have formed therein a plurality of holes 431 into which foreign substance outlets 414 provided at lower ends of the plurality of cyclone units 411 may be respectively inserted.

The cyclone body 410 may be supported by the mounting member 450. The mounting member 450 is provided with communicating passages 451 connected to the plurality of cyclone units 411 of the cyclone body 410. The air from which fine dust is separated by the plurality of cyclone units 411 may be discharged via the communication portions 451. A sealing member 452 may be provided between the mounting member 450 and the dust collecting casing 210.

A flow guide 453 may be provided on an outer circumferential surface of the mounting member 450 to guide movement of the air drawn in through the air inlet 211 of the dust collecting casing 210. The flow guide 453 guides the air drawn in through the air inlet 211 to form a swirling airflow that revolves around the cyclone module 300.

The dust separation member 520 has the dust collecting chamber 531 in which foreign substances separated by the cyclone body 410 are collected. The dust separation member 520 may be detachably assembled to the inner casing 510.

Referring to FIGS. 3 and 4, the inner casing 510 and the dust separation member 520 are assembled together to form an outer circumferential surface of the cyclone module 300. The cyclone module 300 is installed coaxially with the dust collecting casing 210. The outer circumferential surface of the cyclone module 300 is spaced apart from an inner circumferential surface of the dust collecting casing 210. The first cyclone 101 is formed between the outer circumferential surface of the cyclone module 300 and the inner circumferential surface of the dust collecting casing 210.

The air drawn in through the air inlet 211 passes through the flow guide 453 to form an airflow that swirls around the cyclone module 300. In the first cyclone 101, foreign substances having a large size, such as hair or dust larger than holes of the mesh filter 512, are primarily separated from the air drawn in via the air inlet 211 by using a centrifugal force. The separated large foreign substances are accumulated on the bottom surface of the dust collecting casing 210 formed by the discharge door 220.

The air from which the large foreign substances are separated is introduced into the intermediate chamber 513 via the mesh filter 512 of the cyclone barrier 511. In the second cyclone 102 formed by each of the plurality of cyclone units 411, small foreign substances such as fine dust, etc. are separated using a centrifugal force. The foreign substances separated in the second cyclone 102 move to the dust collecting chamber 531 of the dust separation member 520 through the foreign substance outlet 414 of the cyclone unit 411 and are accumulated therein. The air from which foreign substances are separated in the second cyclone 102 is discharged through the air outlet 413.

The dust collecting chamber 531 may have a dust discharge pipe 532 capable of discharging dust at a bottom thereof. The dust discharge pipe 532 is opened and closed by the discharge door 220. When the discharge door 220 is in the open position 221, foreign substances collected in the dust collecting chamber 531 may be discharged through the dust discharge pipe 532. In addition, when the discharge door 220 is in the open position 221, relatively large foreign substances collected between the dust collecting casing 210 and the outer circumference surface of the cyclone module 300 may be discharged.

Figure 5:
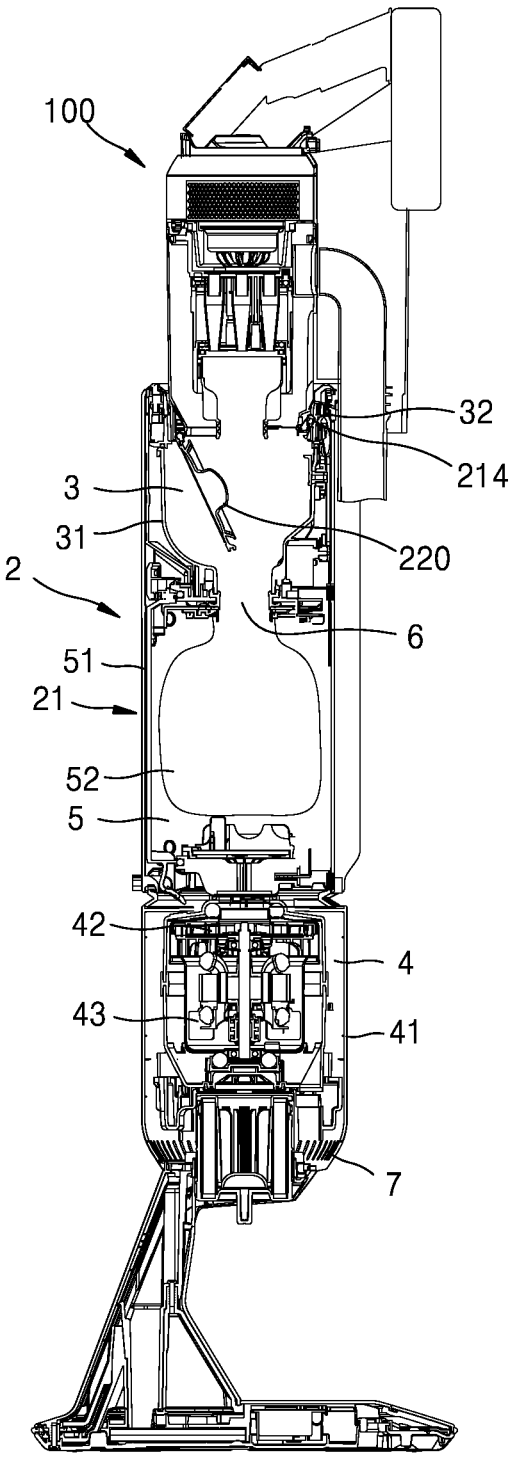
FIG. 5 is a cross-sectional view of a cleaning device according to an embodiment of the disclosure.
Figure 6:
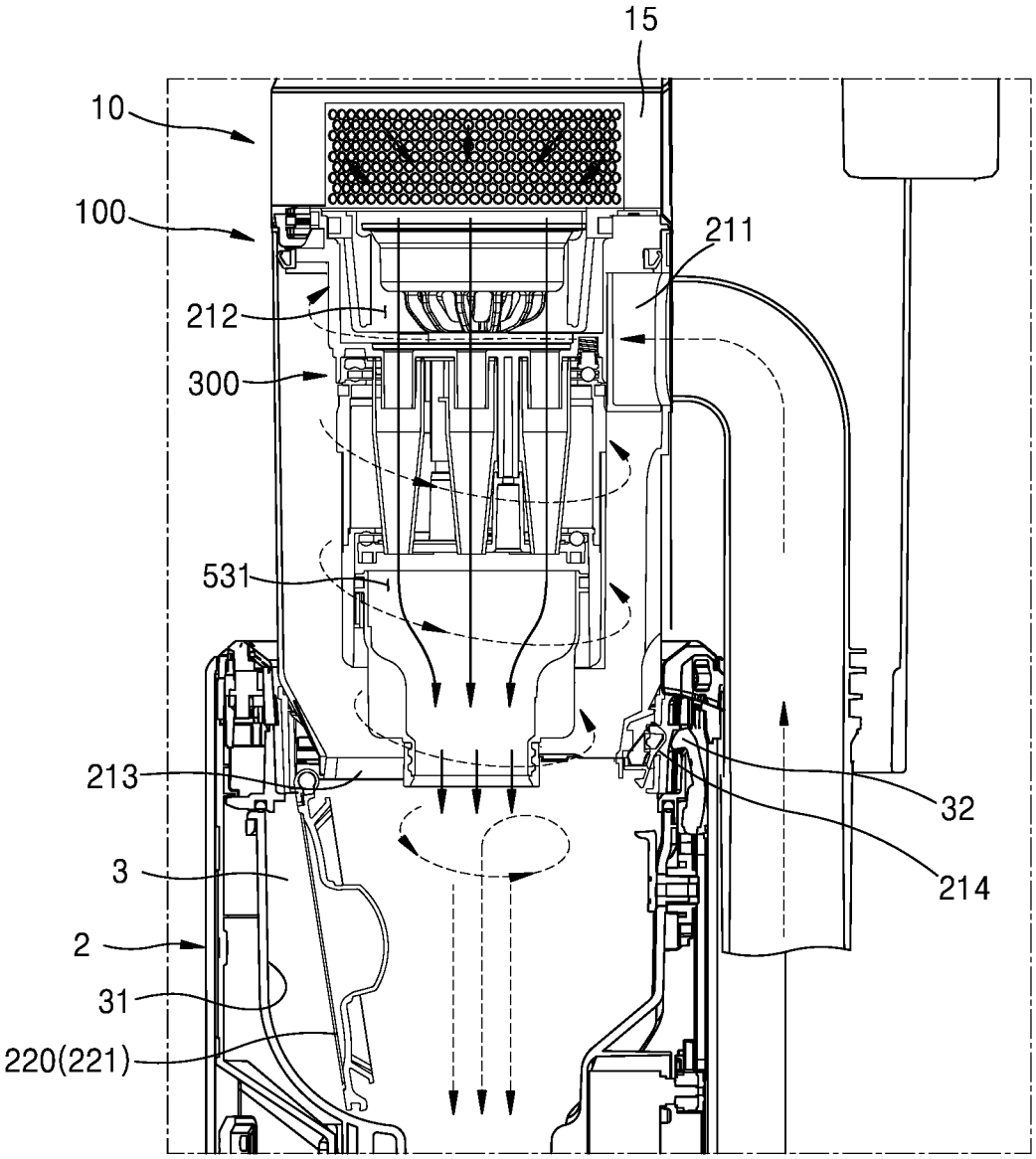
FIG. 6 illustrates a part of a cross-sectional view of a cleaning device according to an embodiment of the disclosure.

FIG. 5 is a cross-sectional view of a cleaning device according to an embodiment of the disclosure. FIG. 6 illustrates a part of a cross-sectional view of the cleaning device according to an embodiment of the disclosure.

Referring to FIGS. 1 and 5, according to an embodiment of the disclosure, the cleaner station 2 may include a suction unit 4 to discharge foreign substances collected in the dust collector 100 from the dust collector 100. The suction unit 4 may be provided inside a station main body 21, and includes a suction fan 42 for moving air and a suction motor 43 for rotating the suction fan 42.

According to an embodiment of the disclosure, the cleaner station 2 may include a collector 5 in which foreign substances discharged from the dust collector 100 are collected. The collector 5 may be provided inside the station main body 21. The collector 5 may be provided upstream from the suction unit 4 with respect to the flow of air.

According to an embodiment of the disclosure, the cleaner station 2 may include a suction flow path 6 having one end connected to the dust collector 100 and the other end connected to the suction unit 4 and through which air moved by the suction unit 4 flows.

In detail, the suction flow path 6 may connect the docking part 3 to the suction unit 4. In this case, the collector 5 may be provided on the suction flow path 6. In other words, the suction flow path 6 connects the docking part 3 to the collector 5 so that foreign substances discharged from the dust collector 100 are sucked into the collector 5 via the docking part 3.

The docking part 3 may include a settling groove 31 which communicates with the suction flow path 6 and in which the dust collector 100 is settled.

The settling groove 31 is a space in the docking part 3 which is open toward the outside so that the dust collector 100 is inserted and settled into the settling groove 31. When the dust collector 100 is settled in the settling groove 31, docking of the dust collector 100 onto the cleaner station 2 may be completed.

Although not shown in the drawings, a sensor may be provided in the settling groove 31 to detect whether the dust collector 100 is connected. Therefore, when the dust collector 100 is settled in the settling groove 31, the cleaner station 2 may identify a state in which the dust collector 100 is docked onto the cleaner station 2 based on an output value of the sensor.

The cleaner station 2 may include an opening guide 32 configured to open a discharge door 220 when the dust collector 100 is connected to the cleaner station 2.

For example, referring to FIGS. 2 and 5, the opening guide 32 may be configured to press the door lock member 214 of the dust collector 100. The opening guide 32 may be formed as a part of an inner circumferential surface of the settling groove 31. However, the opening guide 32 is not limited thereto and may be formed as a region protruding from the inner circumference of the settling groove 31 toward a center thereof, or have a form of a protrusion, a rib, or the like protruding from the inner circumference of the settling groove 31 toward the center. However, a location and a type of the opening guide 32 are not limited to the above example, and the opening guide 32 may be provided in any form without limitation as long as it has a structure capable of opening the discharge door 220 when the dust collector 100 is settled in the settling groove 31.

When the dust collector 100 is docked onto the docking part 3, the door lock member 214 is automatically pressed against the opening guide 32 so that the discharge door 220 may be opened as the dust collector 100 is docked on the cleaner station 2.

The suction flow path 6 may pass through the station main body 21 from the docking part 3 to be connected to the suction unit 4. The suction flow path 6 may transmit a suction force generated by the suction unit 4 to the dust collector 100 to form a suction airflow that moves from the dust collector 100 toward the suction unit 4. In other words, the suction force generated by the suction unit 4 is transmitted to the inside of the dust collector 100 along the collector 5 and the settling groove 31 through the suction flow path 6, such that foreign substances in the dust collector 100 may be discharged from the dust collector 100 into the settling groove 31 along the suction airflow and the discharged foreign substances are then collected in the collector 5 via the suction flow path 6.

The collector 5 may include a collector housing 51 and a dust bag 52 that is provided in an inner space of the collector housing 51 and collects foreign substances introduced via the suction flow path 6.

The collector housing 51 may form an internal space. In other words, the collector housing 51 may correspond to a part of the suction flow path 6, but for convenience of description, it will be described as a separate component.

The dust bag 52 is formed of a material that allows air to pass through while preventing foreign substances from passing through, so that foreign substances introduced from the dust collector 100 into the collector 5 may be collected therein. The dust bag 52 may be provided on the suction flow path 6 and be detachable from the collector 5.

The suction unit 4 may include the suction fan 42, the suction motor 43 for rotating the suction fan 42, and a suction unit housing 41 forming an inner space in which the suction fan 42 is provided. The suction unit housing 41 may be provided in the station main body 21 and may include an outlet 7 for discharging air sucked by the suction fan 42.

A suction force generated by the suction fan 42 may be transmitted from the inner space of the suction unit housing 41 to the collector 5 and then to the dust collector 100 along the suction flow path 6.

According to an embodiment of the disclosure, the cleaner station 2 may selectively change the amount of a suction airflow supplied to the dust collector 100. For example, a change in the amount of suction airflow may be induced according to control by the suction motor 43. As another example, a change in the amount of suction airflow may be induced by a flow adjusting device (not shown) that controls a cross-sectional area of the suction flow path 6 through the suction airflow moves.

In this way, the suction airflow that moves from the dust collector 100 toward the suction unit 4 may be induced by rotating the suction fan 42, and air sucked from the dust collector 100 may pass through the collector 5 and be expelled from the cleaner station 2. In addition, by selectively changing the amount of a suction airflow supplied to the dust collector 100, the foreign substances collected in the dust collector 100 may be discharged more efficiently.

Referring to FIG. 6, movement of air occurs within the dust collector 100 due to a suction force supplied by the cleaner station 2. For example, air is introduced via the air inlet 211 and the air outlet 212, and the air introduced via the air inlet 211 passes through the first cyclone 101 and is discharged via the foreign substance discharge port 213 while the air introduced via the air outlet 212 passes through the second cyclones 102 and is discharged via the foreign substance discharge port 213.

For example, the air introduced via the air inlet 211 moves along the outer circumferential surface of the cyclone module 300 and is discharged through the foreign substance discharge port 213, and air introduced via the filter housing 15 passes through the air outlet 212, the cyclone units 411, and the dust collecting chamber 531 and is discharged through the foreign substance discharge port 213. Thus, the foreign substances collected in the dust collector 100 may be quickly discharged into the docking part 3 of the cleaner station 2.

According to an embodiment of the disclosure, the dust collector 100 has a structure in which a part of the cyclone module 300 is rotatable to minimize the amount of foreign substances remaining in the dust collecting casing 210.

Figure 7:
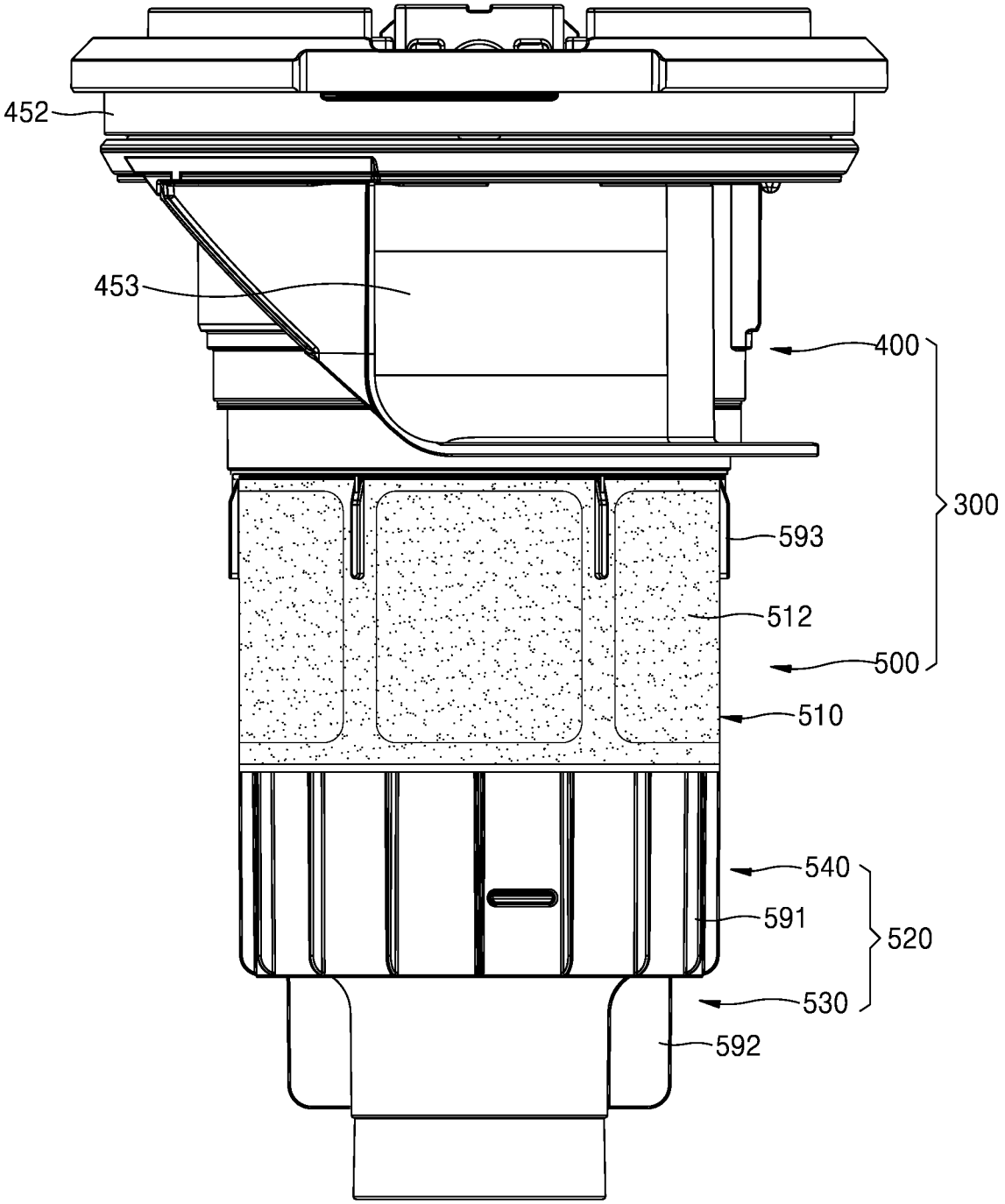
FIG. 7 is a front view of a cyclone module of a dust collector, according to an embodiment of the disclosure.
Figure 8:
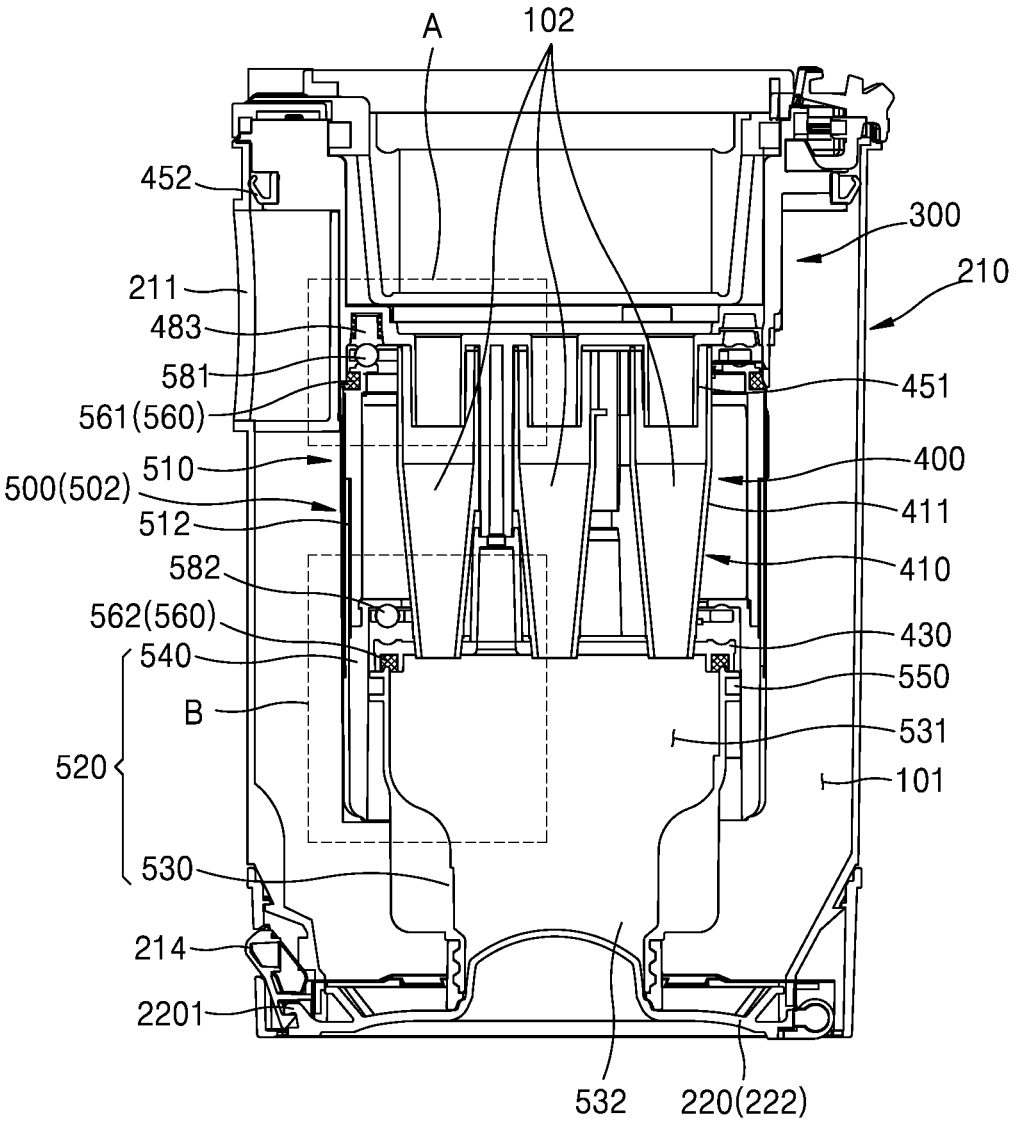
FIG. 8 is a cross-sectional view showing a state of a dust collector when a discharge door is in a closed position, according to an embodiment of the disclosure.
Figure 9:
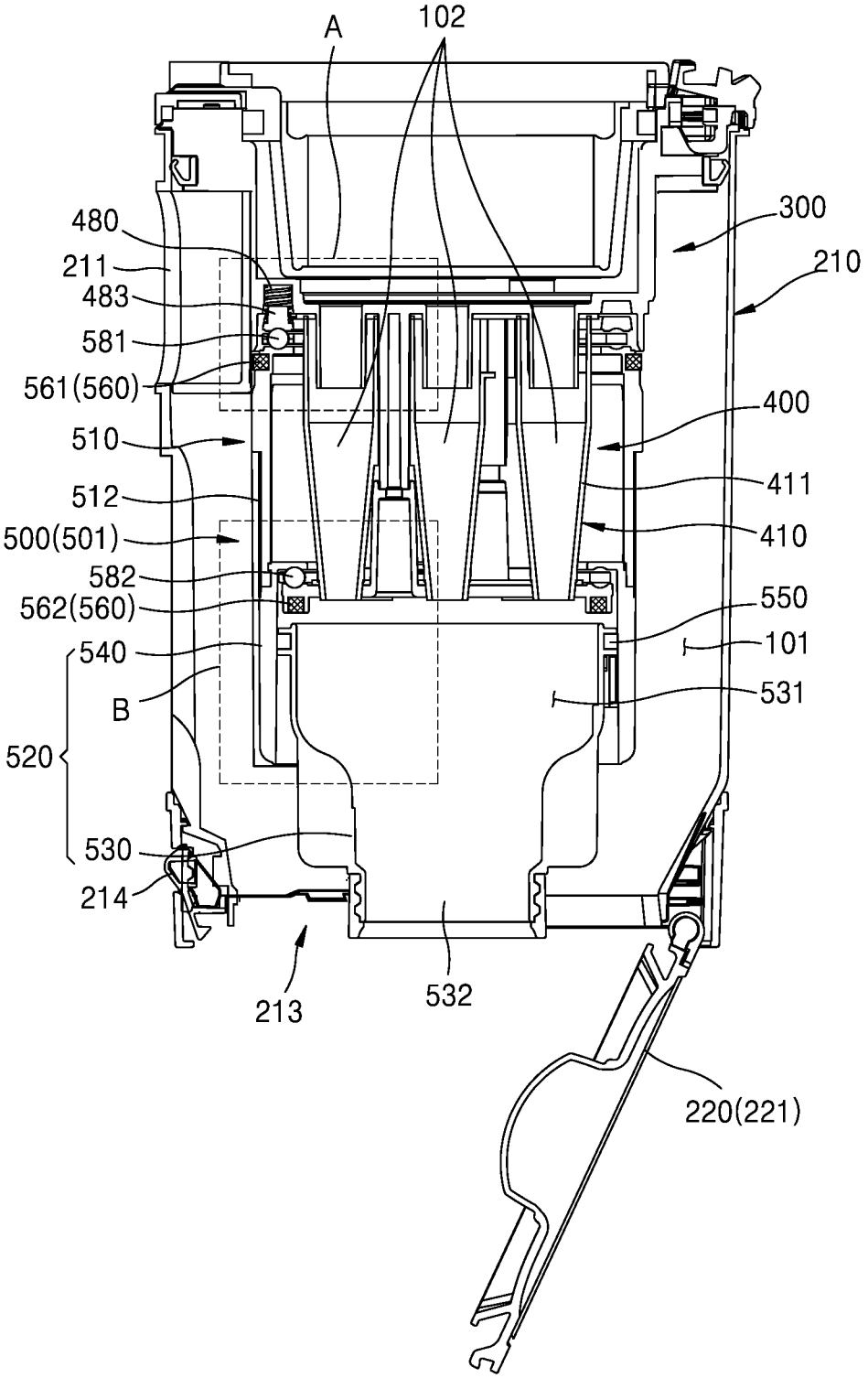
FIG. 9 is a cross-sectional view showing a state of a dust collector when a discharge door is in an open position, according to an embodiment of the disclosure.

FIG. 7 is a front view of the cyclone module 300 of the dust collector 100, according to an embodiment of the disclosure. FIG. 8 is a cross-sectional view showing a state of the dust collector 100 when the discharge door 220 is in the closed position 222, according to an embodiment of the disclosure, and FIG. 9 is a cross-sectional view showing a state of the dust collector 100 when the discharge door 220 is in the open position 221, according to an embodiment of the disclosure.

Referring to FIG. 7, the cyclone module 300 according to the embodiment of the disclosure may include a fixed part 400 fixed to the dust collecting casing 210 and a rotating part 500 rotatable with respect to the fixed part 400. When the discharge door 220 is in the open position 221, the rotating part 500 of the cyclone module 300 may be rotated, and accordingly, foreign substances within the dust collector 100 may be efficiently removed.

When foreign substances stored in the dust collector 100 are discharged due to the suction force supplied by the cleaner station 2 without rotation of the rotating part 500, some foreign substances such as hair, etc. may not be separated by the cyclone module 300 but remain inside the dust collecting casing 210. In this case, the user may be inconvenienced in having to separately remove the foreign substances remaining in the dust collecting casing 210.

On the other hand, in the cyclone module 300 according to the embodiment of the disclosure, the rotating part 500 may be configured to rotate in the process of discharging foreign substances, thereby minimizing the amount of foreign substances remaining in the dust collecting casing 210.

However, in the dust collection process performed by the dust collector 100, other than the foreign substance discharging process, the rotation of the rotating part 500 may degrade the dust collection performance. For example, such rotation may cause a gap to occur between the rotating part 500 and the fixed part 400, so that dust may be introduced through the gap or an unintended flow may occur. By taking this problem into account, according to an embodiment of the disclosure, the rotating part 500 of the cyclone module 300 may be permitted to rotate during the dust discharging process but prevented from rotating during the dust collection process.

Referring to FIGS. 8 and 9, the rotating part 500 may be selectively permitted to rotate according to the position of the discharge door 220. The rotating part 500 may have a rotating state 501 in which it is allowed to rotate with respect to the fixed part 400 when the discharge door 220 is in the open position 221 and a locked state 502 in which it is prevented from rotating with respect to the fixed part 400 when the discharge door 220 is in the closed position 222. Due to this configuration, in the dust collector 100 according to the embodiment of the disclosure, when the foreign substances are discharged to the outside through the foreign substance discharge port 213 of the dust collecting casing 210, the rotating part 500 rotates to induce discharging of the remaining foreign substances, while when the foreign substance discharge port 213 of the dust collecting casing 210 is blocked by the discharge door 220 so that foreign substances are collected in the dust collecting casing 210, the rotating part 500 is prevented from rotating to thereby prevent degradation of the dust collection performance.

As an example, as shown in FIG. 9, when the discharge door 220 is switched from the closed position 222 to the open position 221, the rotating part 500 may move downward to be switched from the locked state 502 to the rotating state 501. As shown in FIG. 8, when the discharge door 220 is switched from the open position 221 to the closed position 222, the rotating part 500 may move upward to be switched from the rotating state 501 to the locked state 502.

Figure 10:
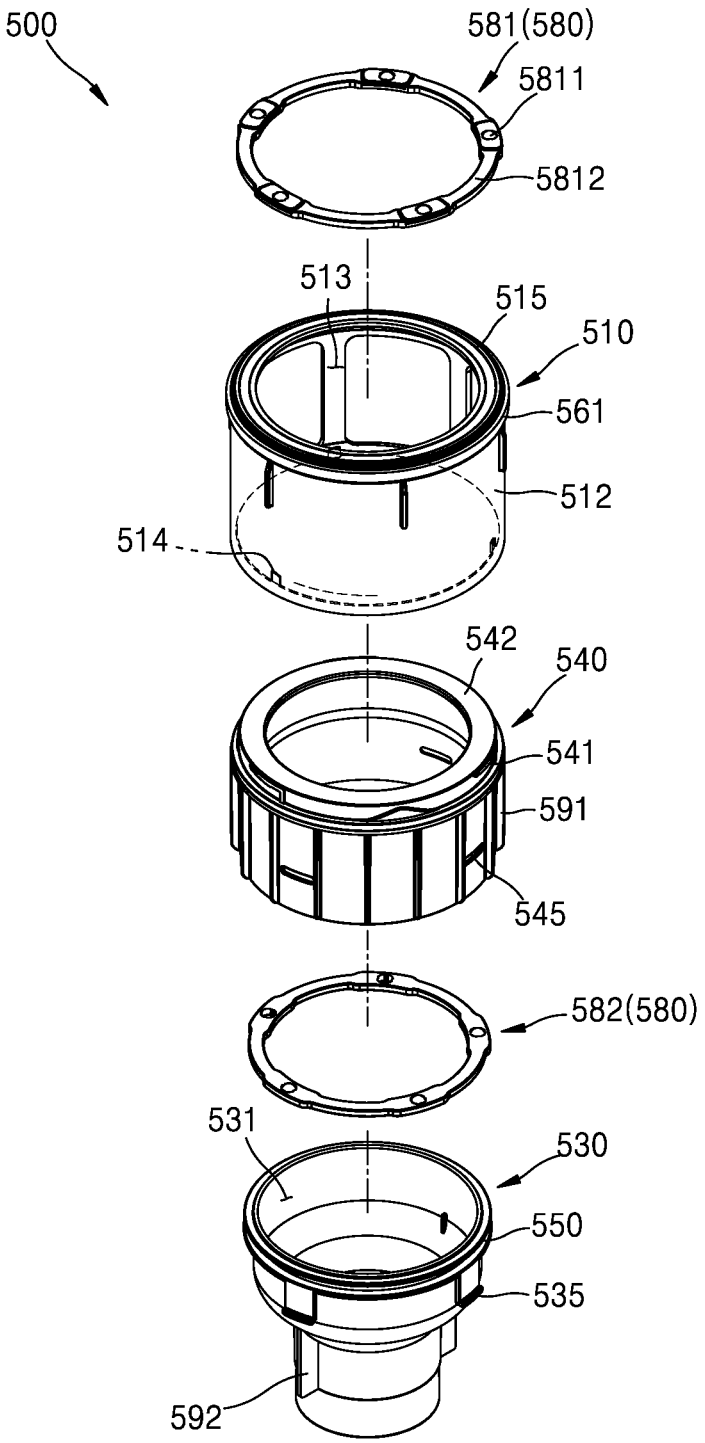
FIG. 10 is an exploded perspective view of a rotating part according to an embodiment of the disclosure.
Figure 11:
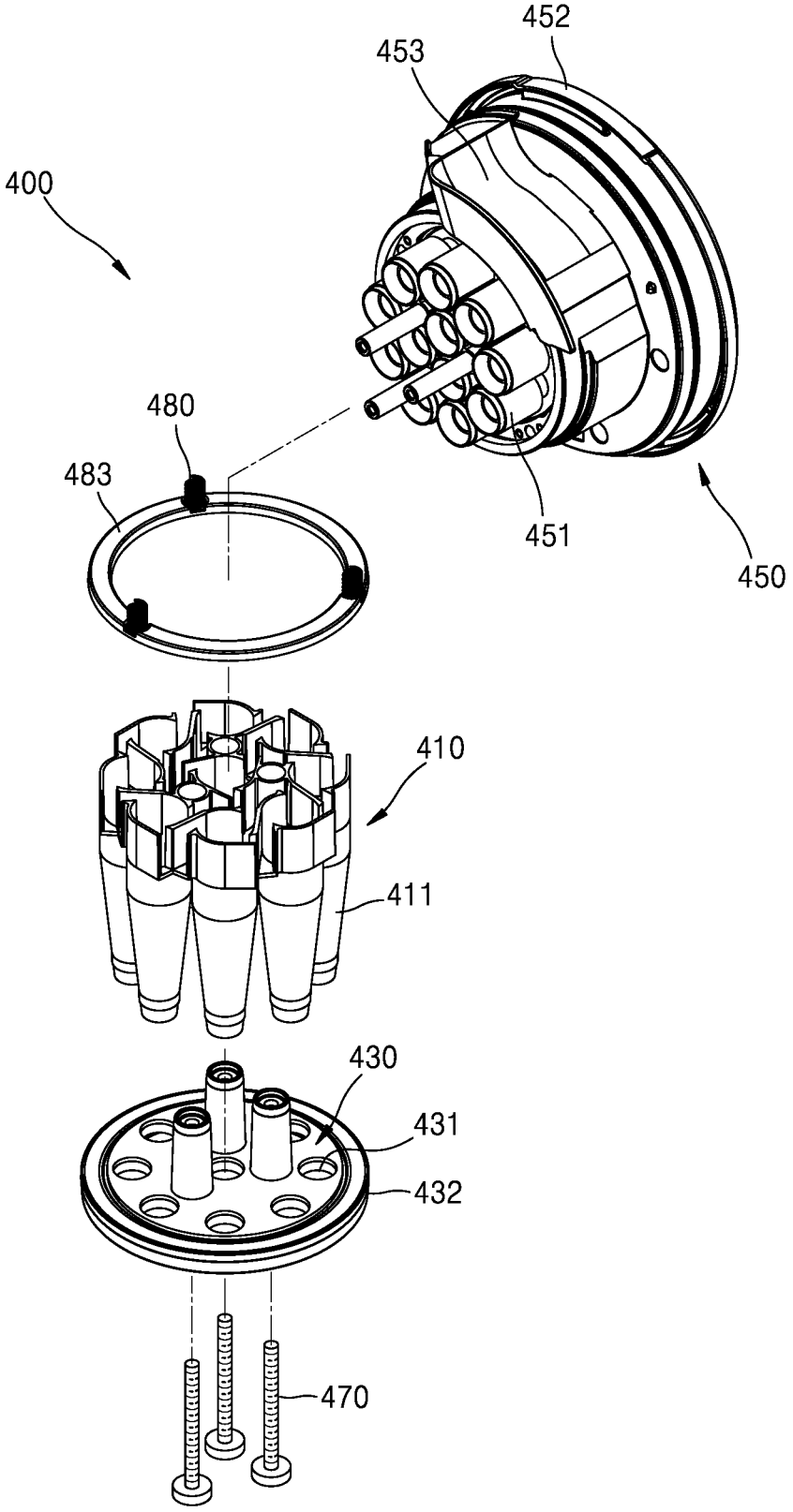
FIG. 11 is an exploded perspective view of a fixed part according to an embodiment of the disclosure.
Figure 12A:
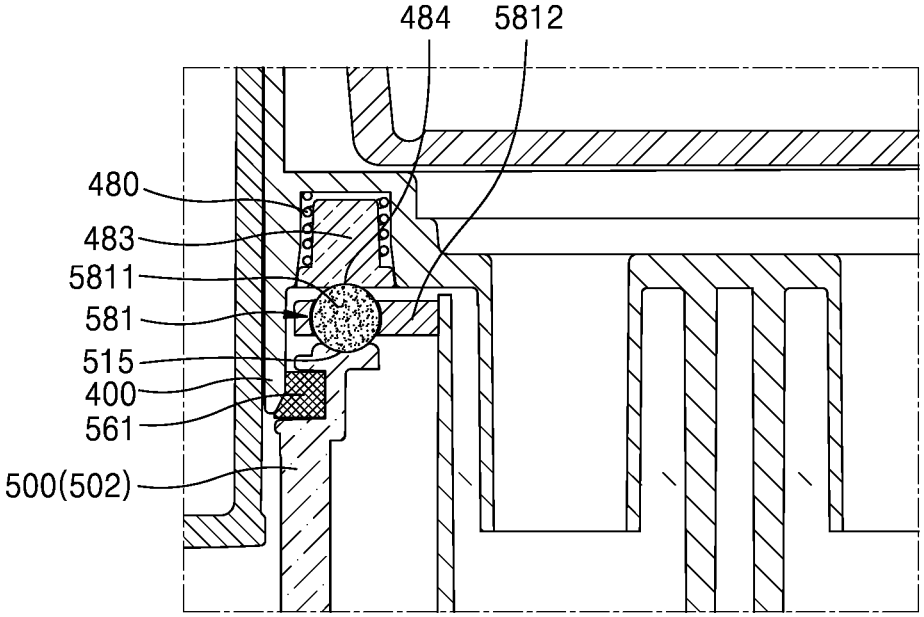
FIG. 12A is an enlarged partial cross-sectional view of region A of a cyclone module according to the embodiment of the disclosure of FIG. 8.
Figure 12B:
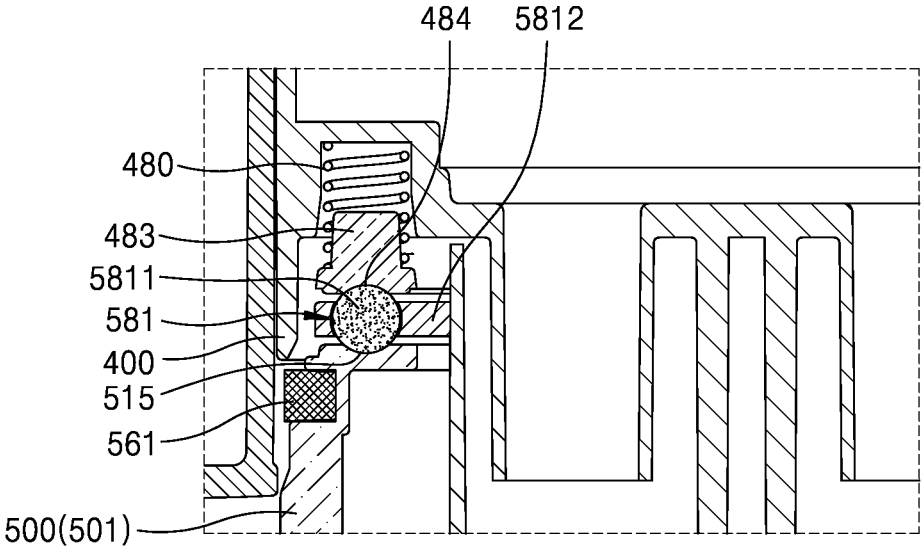
FIG. 12B is an enlarged partial cross-sectional view of the region A of the cyclone module according to the embodiment of the disclosure of FIG. 9.
Figure 13A:
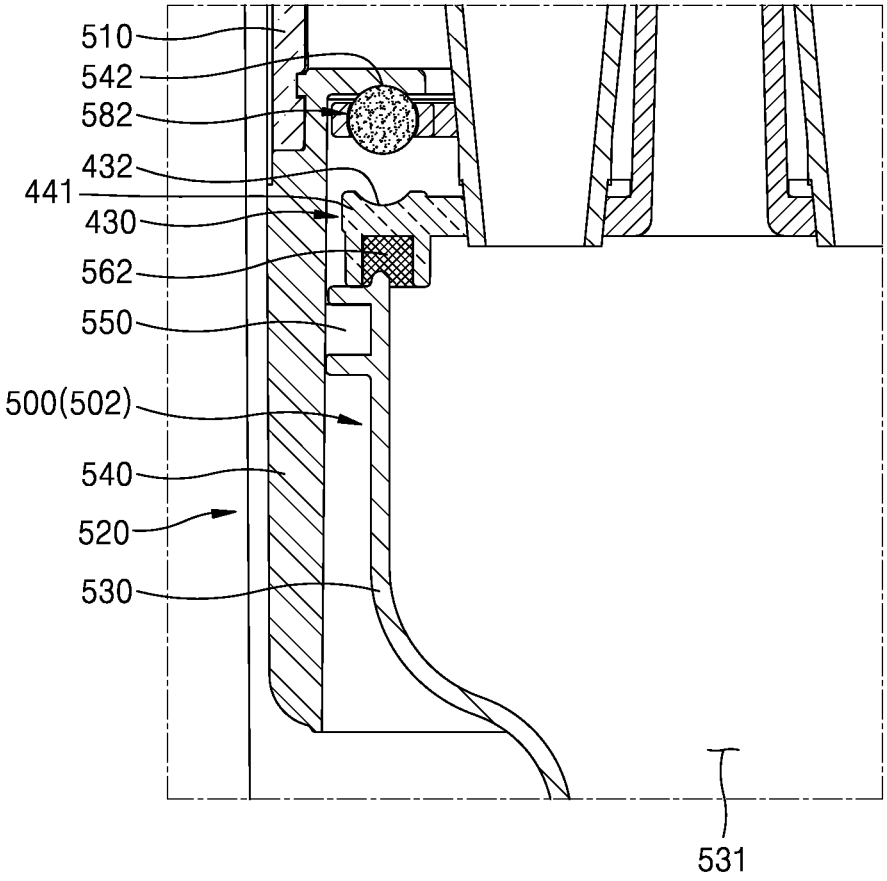
FIG. 13A is an enlarged partial cross-sectional view of region B of the cyclone module according to the embodiment of the disclosure of FIG. 8.
Figure 13B:
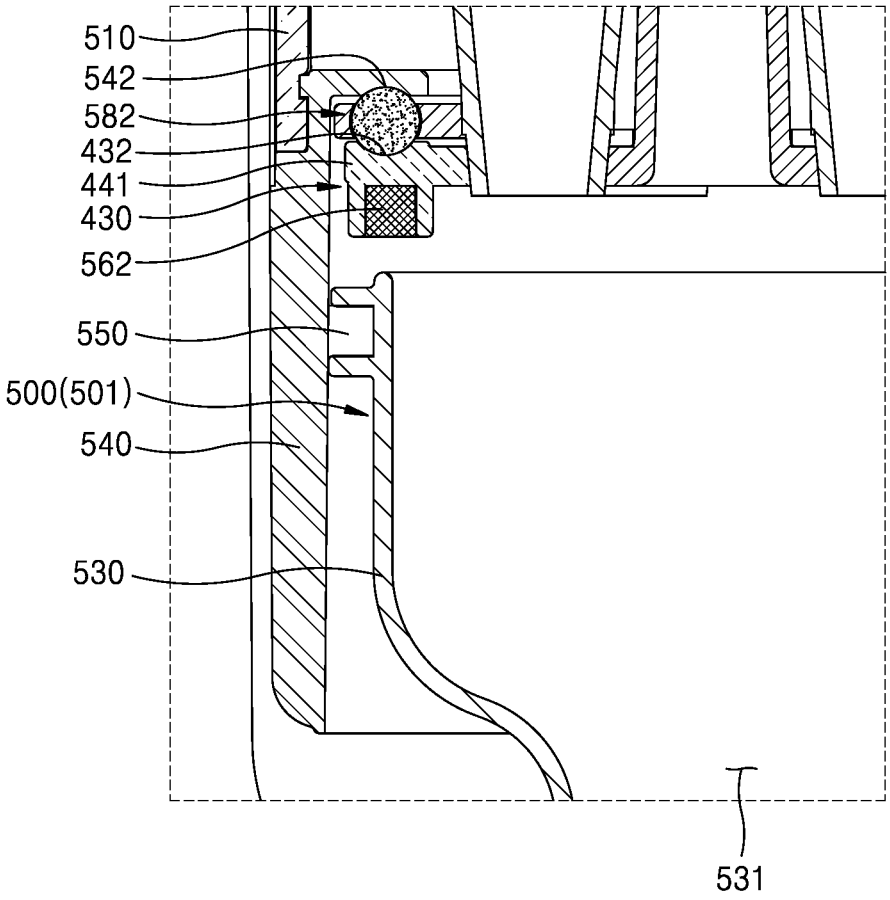
FIG. 13B is an enlarged partial cross-sectional view of the region B of the cyclone module according to the embodiment of the disclosure of FIG. 9.
Figure 14:
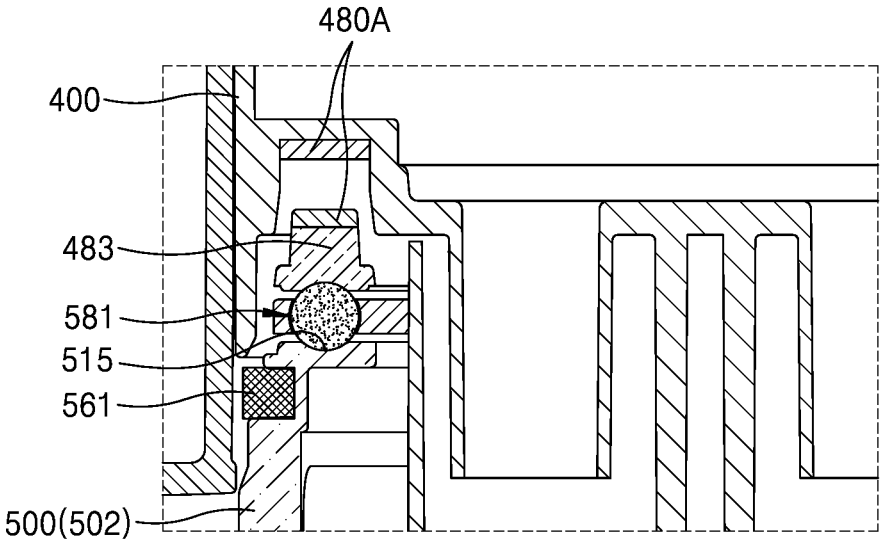
FIG. 14 is a cross-sectional view for explaining a pressure member according to an embodiment of the disclosure.

FIG. 10 is an exploded perspective view of the rotating part 500 according to an embodiment of the disclosure, and FIG. 11 is an exploded perspective view of the fixed part 400 according to an embodiment of the disclosure. FIG. 12A is an enlarged partial cross-sectional view of region A of the cyclone module 300 according to the embodiment of the disclosure of FIG. 8, and FIG. 12B is an enlarged partial cross-sectional view of the region A of the cyclone module 300 according to the embodiment of the disclosure of FIG. 9. FIG. 13A is an enlarged partial cross-sectional view of region B of the cyclone module 300 according to the embodiment of the disclosure of FIG. 8, and FIG. 13B is an enlarged partial cross-sectional view of the region B of the cyclone module 300 according to the embodiment of the disclosure of FIG. 9. FIG. 14 is a cross-sectional view for explaining pressure members 480A according to another example.

Referring to FIGS. 8 and 10, the rotating part 500 is a rotatable component of the cyclone module 300. The first cyclone 101 may be formed between the inner circumferential surface of the dust collecting casing 210 and an outer circumferential surface of the rotating part 500. The rotating part 500 may include the inner casing 510 including the mesh filter 512 and a dust separation member 520 assembled to the inner casing 510.

The dust separation member 520 includes a dust storage 530 forming the dust collecting chamber 531, and a support wall 540 surrounding and supporting the dust storage 530. The dust storage 530 and the support wall 540 may be assembled and fixed together. The dust storage 530 and the support wall 540 may be assembled together by a coupling protrusion 535 and a coupling groove 545. A sealing member 550 may be provided between the dust storage 530 and the support wall 540.

The support wall 540 may be assembled and fixed to the inner casing 510. For example, the support wall 540 may be affixed to the inner casing 510 by moving the support wall 540 closer to the inner casing 510 so that a cam protrusion 514 formed on an inner circumferential surface of the inner casing 510 is inserted into a cam groove 541 formed in the support wall 540 and then rotating the support wall 540.

Although in the above example, components of the rotating part 500 are limited to the inner casing 510 and the dust separation member 520, the rotating part 500 is not limited thereto but may include various other components for forming the first cyclone 101.

Referring to FIGS. 8 and 11, the fixed part 400 is a stationary component of the cyclone module 300 that does not rotate, and is fixedly mounted to the dust collecting casing 210. The fixed part 400 includes the cyclone body 410 and the mounting member 450 that supports the cyclone body 410 and is mounted onto the dust collecting casing 210. The fixed part 400 may further include the lower plate 430 installed below the cyclone body 410. The mounting member 450, the cyclone body 410, and the lower plate 430 may be coupled together by a plurality of coupling members 470.

Referring to FIG. 8, the cyclone module 300 further includes a rotation preventing member 560 that prevents the rotating part 500 from rotating with respect to the fixed part 400. When the rotating part 500 is in the locked state 502, the rotation preventing member 560 may provide a rotational friction force between the rotating part 500 and the fixed part 400 to prevent the rotating part 500 from rotating with respect to the fixed part 400.

The rotation preventing member 560 is elastically deformable and may include an elastic member provided on at least one of the rotating part 500 or the fixed part 400. For example, the rotation preventing member 560 may include a first elastic member 561 provided on the outer circumferential surface of the rotating part 500 and a second elastic member 562 provided on a bottom portion of the fixed part 400.

When the discharge door 220 is in the closed position 222 as shown in FIG. 8, the discharge door 220 is in contact with the rotating part 500, and presses the rotating part 500 upward, i.e., toward the fixed part 400. The rotation preventing member 560 is compressively deformed by the rotating part 500. When the discharge door 220 is in the open position 221 as shown in FIG. 9, the discharge door 220 is spaced apart from the rotating part 500, and thus, compressive deformation of the rotation preventing member 560 by the rotating part 500 is released, and the rotating part 500 is rotatable with respect to the fixed part 400.

The first elastic member 561 may be provided to overlap the fixed part 400 in a longitudinal direction. Accordingly, when the rotating part 500 moves upward to be in the locked state 502 as shown in FIGS. 8 and 12A, the first elastic member 561 may be compressively deformed by the fixed part 400, while when the rotating part 500 moves downward to be in the rotating state 501 as shown in FIGS. 9 and 12B, the compression by the fixed part 400 may be released.

The second elastic member 562 may be provided below the fixed part 400 to overlap the rotating part 500 in the longitudinal direction. When the rotating part 500 moves upward to be in the locked state 502 as shown in FIGS. 8 and 13A, the first elastic member 561 may be compressively deformed by the rotating part 500, while when the rotating part 500 moves downward to be in the rotating state 501 as shown in FIGS. 9 and 13B, the compression by the rotating part 500 may be released.

The rotation preventing member 560 may function as a sealing member that prevents dust from entering between the fixed part 400 and the rotating part 500. As an example of the sealing member, various materials such as rubber, plastic, brush, Eva-foam, etc. may be used. Although in this example, two elastic members including elastic materials have been exemplified as the rotation preventing member 560, the disclosure is not limited thereto, and materials and number of the rotation preventing members 560 may vary.

Referring back to FIGS. 8 and 9, when the discharge door 220 is switched from the open position 221 to the closed position 222, the rotating part 500 moves upward to be switched from the rotating state 501 to the locked state 502. As the rotating part 500 moves upward, as shown in FIG. 12A, the first elastic member 561 is compressively deformed by the fixed part 400 in a direction perpendicular to the longitudinal direction, e.g., in a transverse direction, and as shown in FIG. 13A, the second elastic member 562 is compressively deformed by the rotating part 500 in the longitudinal direction. A first rotational friction force is exerted between the rotating part 500 and the fixed part 400 by the compressively deformed first elastic member 561, and a second rotational friction force is exerted between the rotating part 500 and the fixed part 400 by the compressively deformed second elastic member 562. Rotation of the rotating part 500 with respect to the fixed part 400 is limited by the first rotational friction force and the second rotational friction force. When the rotating part 500 is in the locked state 502, a dust collection operation of the dust collector 100 may be performed, and thus, degradation of the dust collection performance due to rotation of the rotating part 500 may be prevented.

When the discharge door 220 is switched from the closed position 222 to the open position 221, the rotating part 500 may move downward to be switched from the locked state 502 to the rotating state 501. As the rotating part 500 moves downward, the compression of the first elastic member 561 by the fixed part 400 is released as shown in FIG. 12B, and the compression of the second elastic member 562 by the rotating part 500 is released as shown in FIG. 13B. Thus, because there is no rotational friction force due to the first elastic member 561 and the second elastic member 562, the rotating part 500 switches to the rotating state 501 so that it is rotatable.

Referring to FIGS. 9 through 11, the cyclone module 300 may further include pressure members 480 for pressing the rotating part 500 to be switched from the locked state 502 to the rotating state 501. The pressure member 480 may press the rotating part 500 so that it may move down. For example, the pressure member 480 may be a spring that provides an elastic force to the rotating part 500 in the longitudinal direction. The pressure member 480 may be provided below the mounting member 450 and elastically deformed in the longitudinal direction without rotation. However, the position and type of the pressure member 480 are not limited thereto, and may be variously modified as long as the pressure member 480 provides a pressing force to the rotating part 500 to be switched from the locked state 502 to the rotating state 501. For example, as shown in FIG. 14, a pressure member 480A may be a magnet that provides a magnetic force to the rotating part 500 in the longitudinal direction. The pressure members 480A may press the rotating part 500 downward using a magnetic repulsive force.

When the discharge door 220 is switched from the closed position 222 to the open position 221, the pressure member 480 provides a pressing force so that the rotating part 500 switches from the locked state 502 to the rotating state 501. When the discharge door 220 is switched from the closed position 222 to the open position 221, gravity exerted according to the weight of the rotating part 500 and the pressing force applied by the pressure member 480 act on the rotating part 500 so that the rotating part 500 switches from the locked state 502 to the rotating state 501. By designing the gravity according to the weight of the rotating part 500 and the pressing force by the pressure member 480 to be greater than a frictional force provided by the rotation preventing member 560, when the discharge door 220 is switched to the open position 221, the rotating part 500 may move down to switch to the rotating state 501.

The cyclone module 300 may include at least one bearing structure 580 that rotatably supports the rotating part 500 with respect to the fixed part 400. For example, the cyclone module 300 may include a first bearing structure 581 and a second bearing structure 582 that are longitudinally spaced apart from each other to rotatably support the rotating part 500 with respect to the fixed part 400. The first bearing structure 581 and the second bearing structure 582 allow the rotating part 500 to smoothly rotate with respect to the fixed part 400 without distortion or shaking of a rotation axis.

For example, the first bearing structure 581 may be provided in an upper region of the rotating part 500, and the second bearing structure 582 may be provided in a lower region of the rotating part 500. For example, the first bearing structure 581 may be provided above the inner casing 510, and the second bearing structure 582 may be provided below the inner casing 510.

Referring to FIGS. 10, 12A, and 12B, at least one of the first bearing structure 581 or the second bearing structure 582 may have a thrust bearing structure. For example, the first bearing structure 581 may have a thrust bearing structure. The first bearing structure 581 may include a plurality of balls 5811 and a bearing frame 5812 rotatably supporting the plurality of balls 5811.

A bearing support groove 515 for supporting the first bearing structure 581 may be formed on a top surface of the inner casing 510. A bearing support 483 with a bearing support groove 484 formed therein for supporting the first bearing structure 581 may also be provided on the first bearing structure 581.

The first bearing structure 581 may be provided below the mounting member 450 of the fixed part 400. The pressure members 480 may be provided between the first bearing structure 581 and the mounting member 450. The pressure members 480 may be installed on the bearing support 483.

Referring to FIGS. 10, 13A and 13B, the second bearing structure 582 may be provided in a lower portion of the rotating part 500. The second bearing structure 582 may be provided inside the dust separation member 520.

For example, the second bearing structure 582 may be provided inside the support wall 540. The second bearing structure 582 may be provided on a bearing support 542 protruding inward from the support wall 540. The second bearing structure 582 may be provided to overlap the lower plate 430 of the fixed part 400 in the longitudinal direction. The lower plate 430 may have formed therein a bearing support groove 432 for supporting the second bearing structure 582. When the rotating part 500 moves downward, the second bearing structure 582 may come in contact with and supported by the bearing support groove 432 of the lower plate 430. The lower plate 430 of the fixed part 400 may function as a stopper for preventing the rotating part 500 from being separated from the fixed part 400. As such, the fixed part 400 may include a stopper 441 for limiting a position to which the rotating part 500 is permitted to move downward. Therefore, when the discharge door 220 is switched to the open position 221, the rotating part 500 continues to move downward until it comes into contact with the stopper 441 of the lower plate 430, and switches to the rotating state 501. At this time, the second bearing structure 582 contacts and is supported by the lower plate 430.

The above embodiment of the disclosure has been described mainly based on an example in which the first bearing structure 581 and the second bearing structures 582 that allow the rotating part 500 to rotate with respect to the fixed part 400 each have a thrust bearing structure and are respectively provided in the upper and lower regions of the rotating part 500. However, the arrangement and structure of the first and second bearing structures 581 and 582 may be variously modified.

Figure 15A:
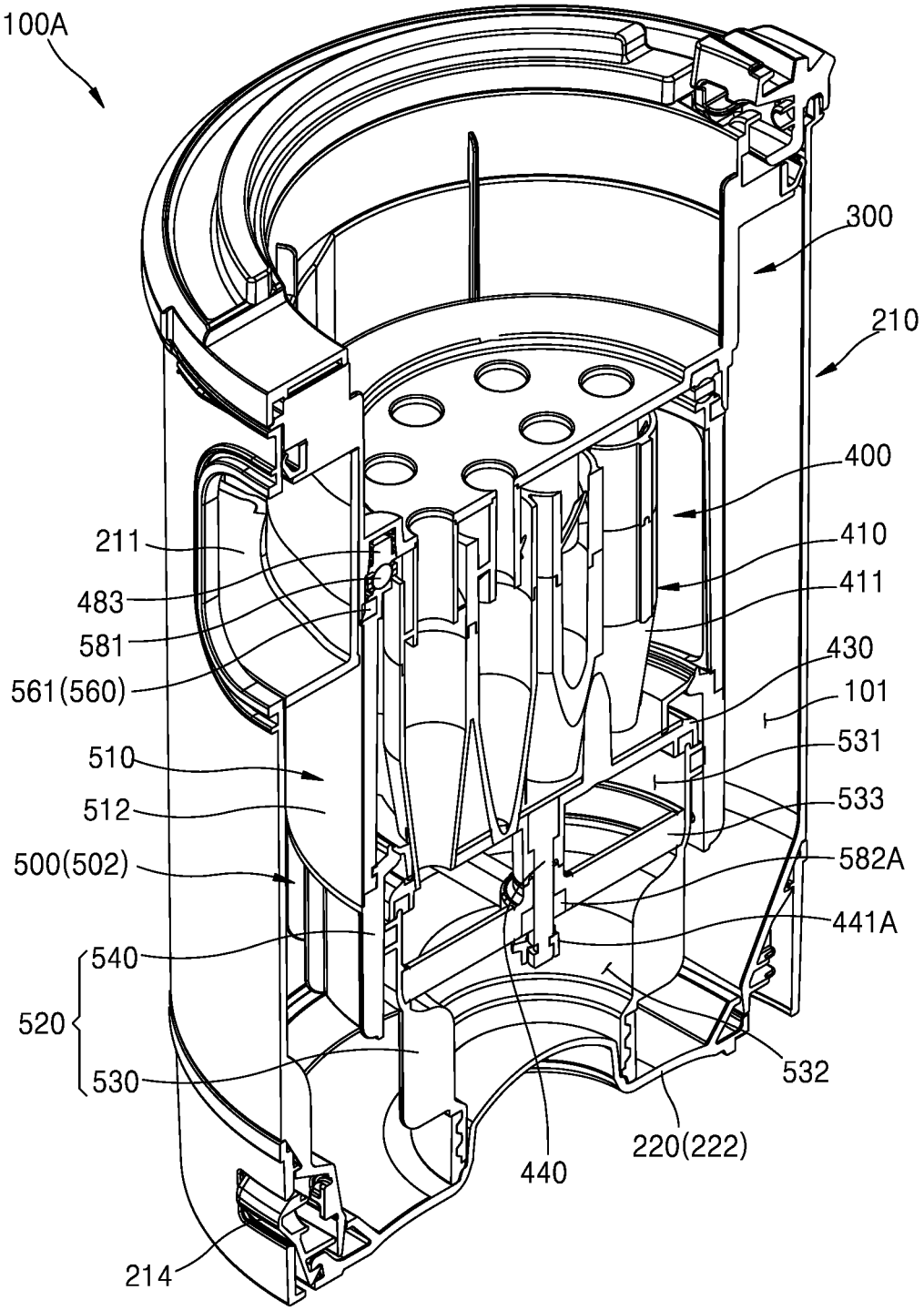
FIG. 15A is a cross-sectional perspective view of a dust collector according to an embodiment of the disclosure.
Figure 15B:
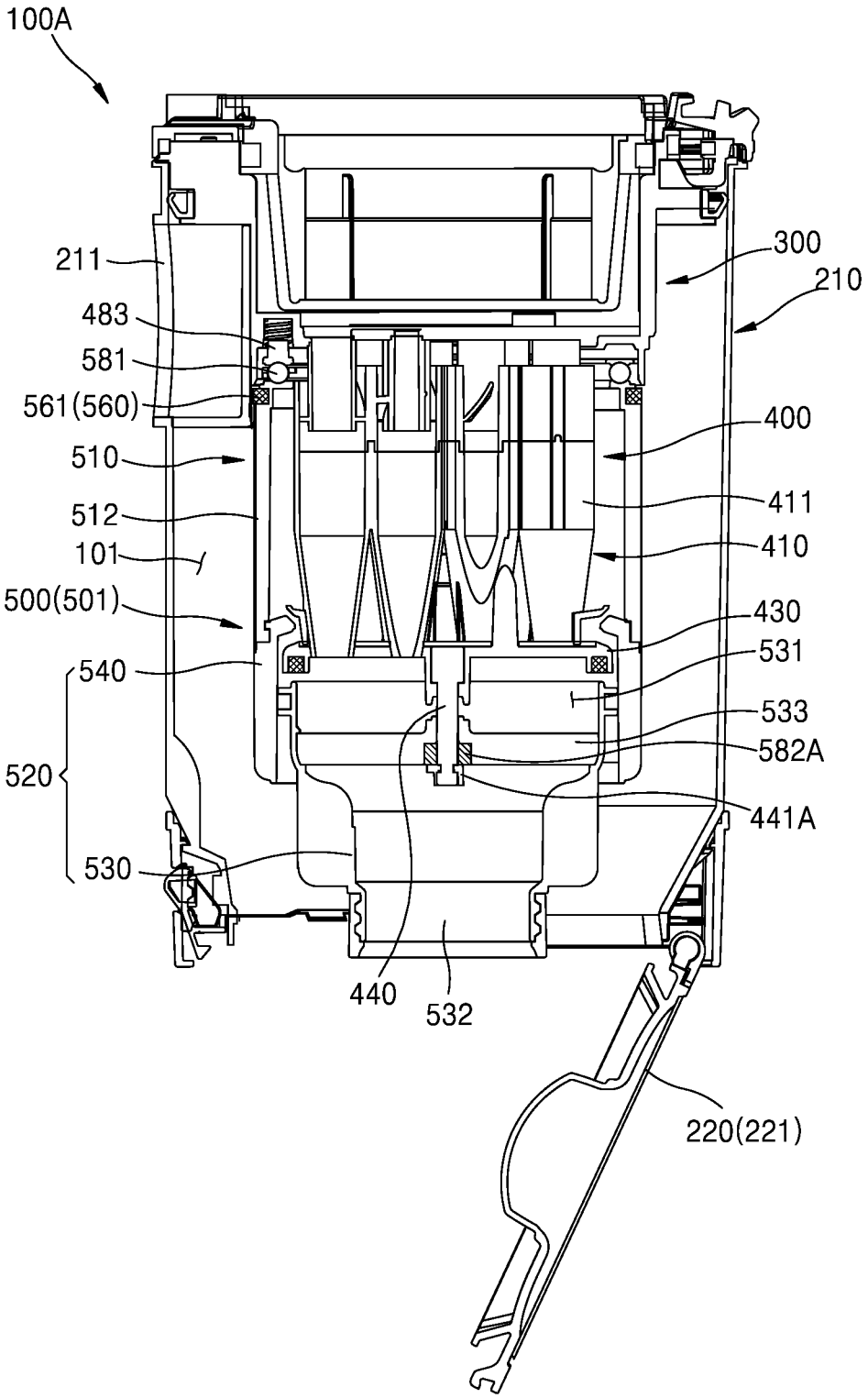
FIG. 15B is a cross-sectional view for explaining a case in which a rotating part of the dust collector is in a rotating state.

FIG. 15A is a cross-sectional perspective view of a dust collector 100A according to an embodiment of the disclosure, and FIG. 15B is a cross-sectional view for explaining a case in which a rotating part 500 of the dust collector 100A is in a rotating state.

Referring to FIGS. 15A and 15B, in the dust collector 100A according to the embodiment of the disclosure, the first bearing structure 581 may be provided in an upper region of the rotating part 500, and a second bearing structure 582A may be provided in a lower region thereof to be overlapped by the cyclone body 410. The second bearing structure 582A may be provided to be overlapped by a central portion of the cyclone body 410.

The second bearing structure 582A may be provided at a center of a connection bridge 533 connecting an inner circumferential surface of the dust storage 530. A rotation shaft 440 may be installed in the fixed part 400 and pass through the second bearing structure 582A. A stopper 441A may be provided on the rotation shaft 440 to limit a position to which the rotating part 500 is permitted to move downward. When the discharge door 220 is switched to the open position 221, the second bearing structure 582A of the rotating part 500 continues to move downward until it comes into contact with the stopper 441A, so that the rotating part 500 is switched to the rotating state 501. At this time, the second bearing structure 582A contacts and is supported by the stopper 441A.

Figure 16A:
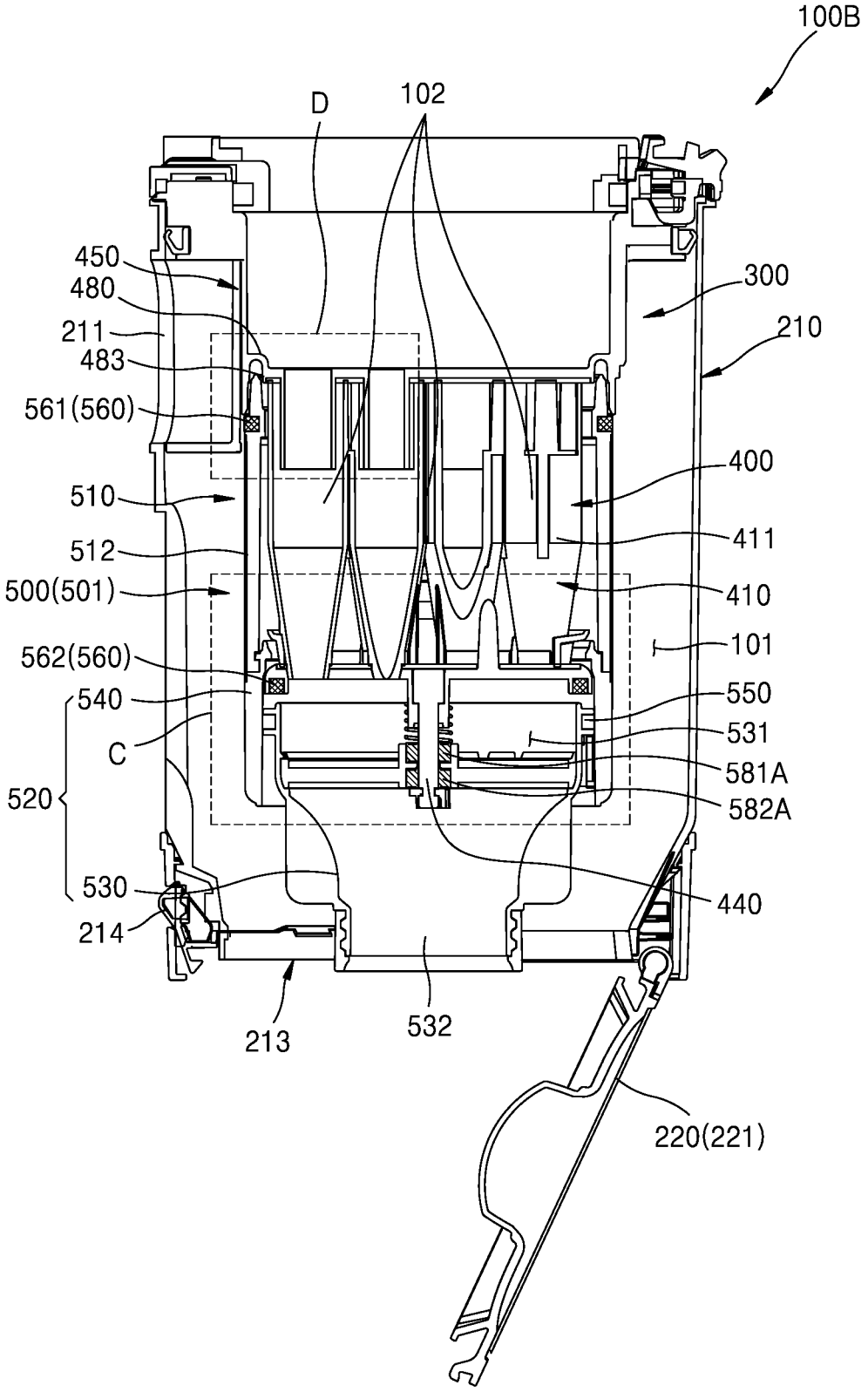
FIG. 16A is a cross-sectional perspective view of a dust collector according to an embodiment of the disclosure.
Figure 16B:
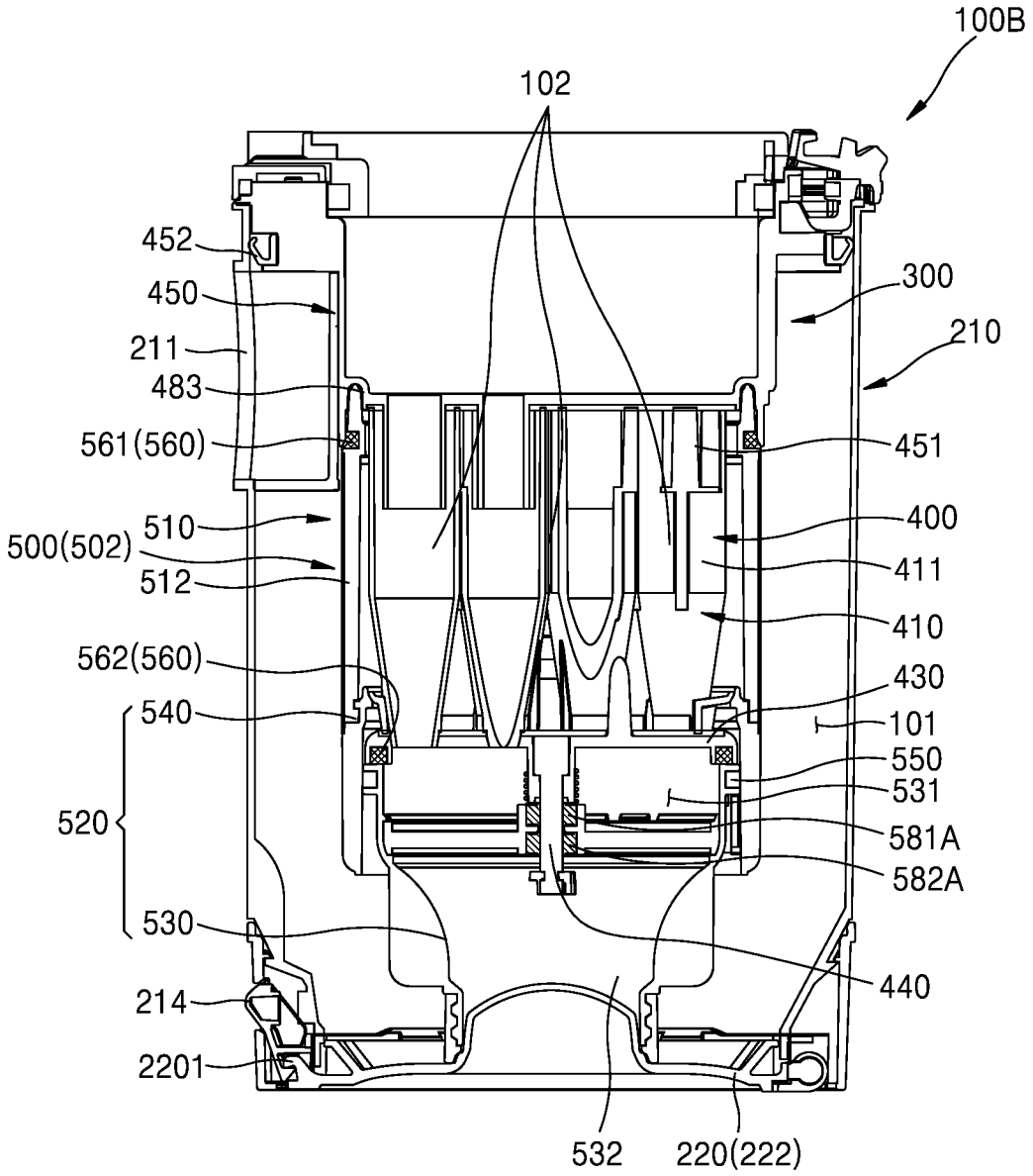
FIG. 16B is a cross-sectional view of the dust collector of FIG. 16A when a rotating part of the dust collector is in a rotating state.
Figure 17:
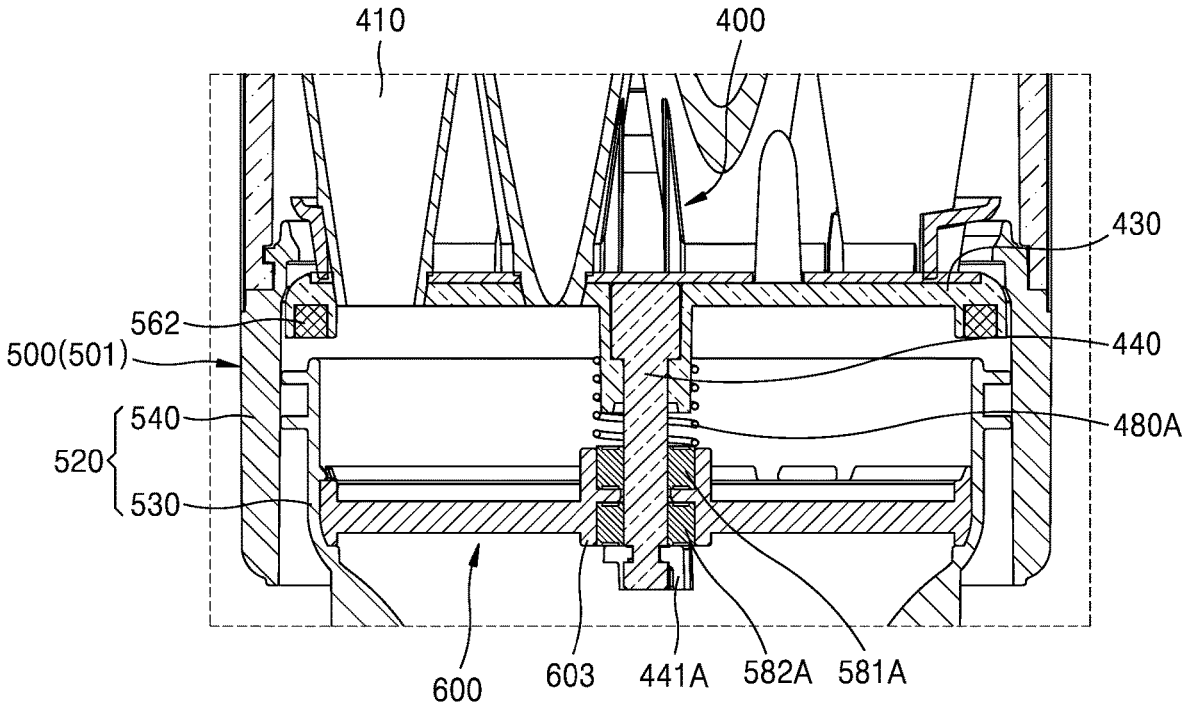
FIG. 17 is an enlarged view of region C in the dust collector of FIG. 16A.
Figure 18:
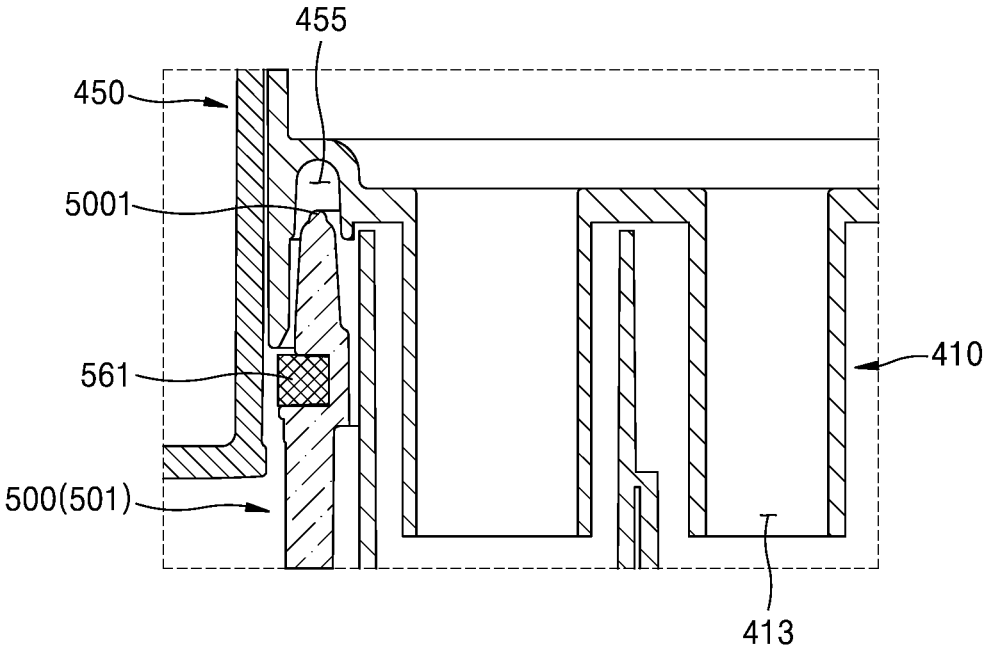
FIG. 18 is an enlarged view of region D in the dust collector of FIG. 16A.

FIG. 16A is a cross-sectional perspective view of a dust collector 100B according to an embodiment of the disclosure, and FIG. 16B is a cross-sectional view of the dust collector 100B of FIG. 16A when a rotating part 500 of the dust collector 100B is in a rotating state 501. FIG. 17 is an enlarged view of region C in the dust collector 100B of FIG. 16A, and FIG. 18 is an enlarged view of region D in the dust collector 100B of FIG. 16A.

Referring to FIGS. 16A, 16B and 17, in the dust collector 100B according to the embodiment of the disclosure, the first bearing structure 581A and the second bearing structure 582A may both be provided in a lower region of the rotating part 500.

The first bearing structure 581A and the second bearing structure 582A may both be provided to be overlapped by the cyclone body 410. The first bearing structure 581A and the second bearing structure 582A may be provided to be overlapped by a central portion of the cyclone body 410.

The first bearing structure 581A and the second bearing structure 582A may both be provided below the dust collecting casing 510 of the rotating part 500. For example, the first bearing structure 581A and the second bearing structure 582A may be provided below the fixed part 400. For example, the first bearing structure 581A and the second bearing structure 582A may be provided below the cyclone body 410. The first bearing structure 581A and the second bearing structure 582A may be provided inside the dust separation member 520. For example, the first bearing structure 581A and the second bearing structure 582A may be provided inside the dust storage 530. provided The first bearing structure 581A and the second bearing structure 582A are both provided around the rotation shaft 440 installed in the fixed part 400. The first bearing structure 581A and the second bearing structure 582A may be ball bearings. However, the first bearing structure 581A and the second bearing structure 582A are not limited thereto, and may be modified in various examples. For example, the first bearing structure 581A and the second bearing structure 582A may be roller bearings.

The first bearing structure 581A and the second bearing structure 582A may be supported on the rotating part 500 by a second rotation guide member 600 as described below. Accordingly, when the rotating part 500 moves upward or downward, the first bearing structure 581A and the second bearing structure 582A also move upward or downward.

As described above, as the first bearing structure 581A and the second bearing structure 582A are provided in the lower region of the rotating part 500, a bearing structure may not be provided in an upper region of the rotating part 500. Because a bearing structure is not provided in the upper region of the rotating part 500, the degrees of freedom in design of the fixed part 400 may be improved. For example, a diameter of the air outlet 413 of the cyclone body 410 may be increased.

Referring to FIGS. 16A and 18, a position control groove 455 may be provided in the mounting member 450 to limit shaking of the upper region of the rotating part 500 when the rotating part 500 rotates. An end portion 5001 of the upper region of the rotating part 500 is inserted into the position control groove 455. The depth and width of the position control groove 455 may be determined based on an elevation height at which the rotating part 500 is able to move upward and shaking of the rotating part 500. For example, the depth of the position control groove 500 is greater than the elevation height of the rotating part 500, and the width of the position control groove 455 is greater than that of the end portion 5001 of the upper region of the rotating part 500.

Referring back to FIG. 17, when the first bearing structure 581A and the second bearing structure 582A are both provided in the lower region of the rotating part 500, pressure members 480A may be provided in the lower region of the rotating part 500. The pressure members 480A may be provided around the rotation shaft 440. The pressure members 480A may be provided between the lower plate 430 and a rotation support 603 and provide a pressing force so that the rotation support 603 faces downward.

Figure 19:
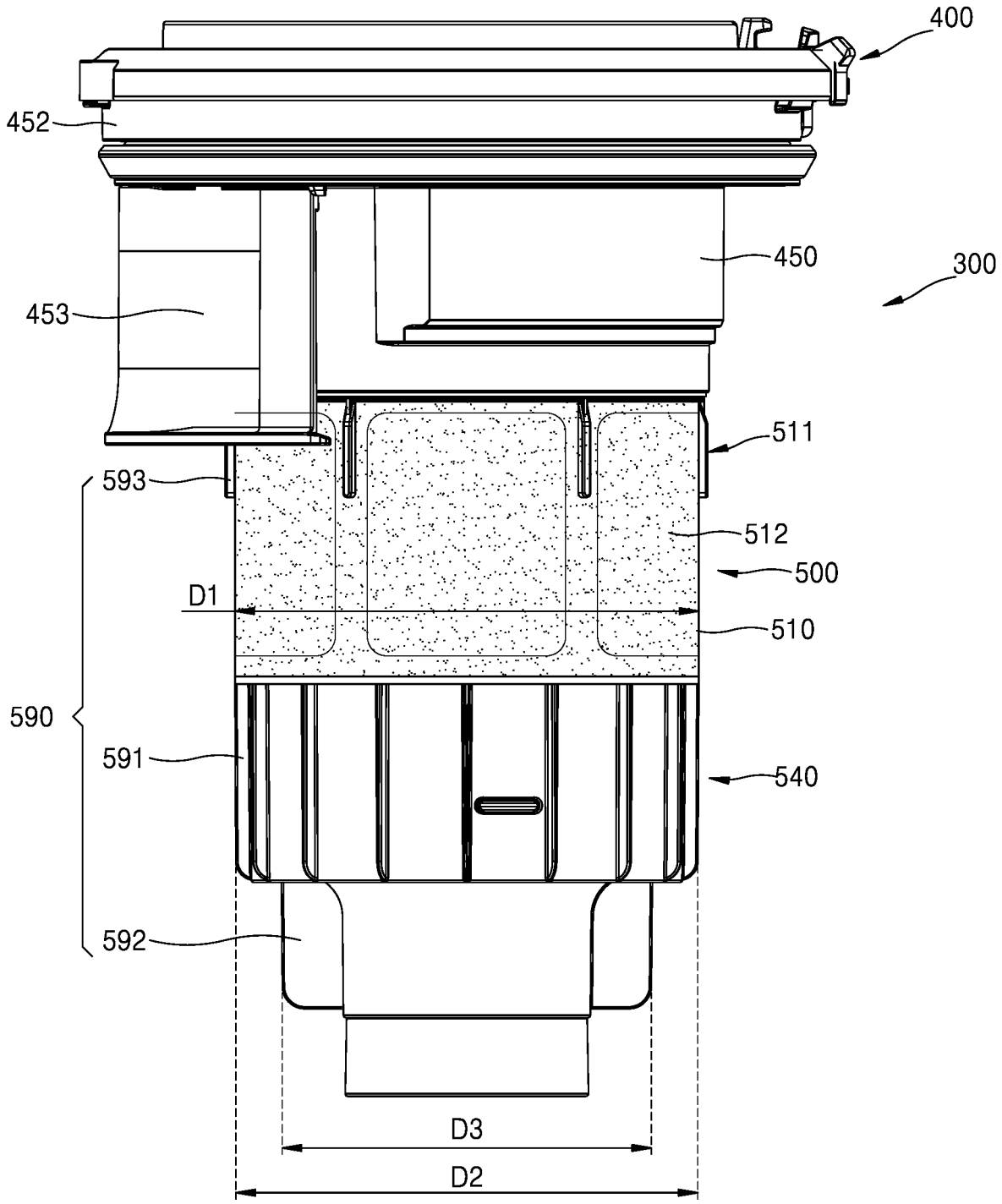
FIG. 19 is a front view of a rotating part of a cyclone module according to an embodiment of the disclosure.
Figure 20:
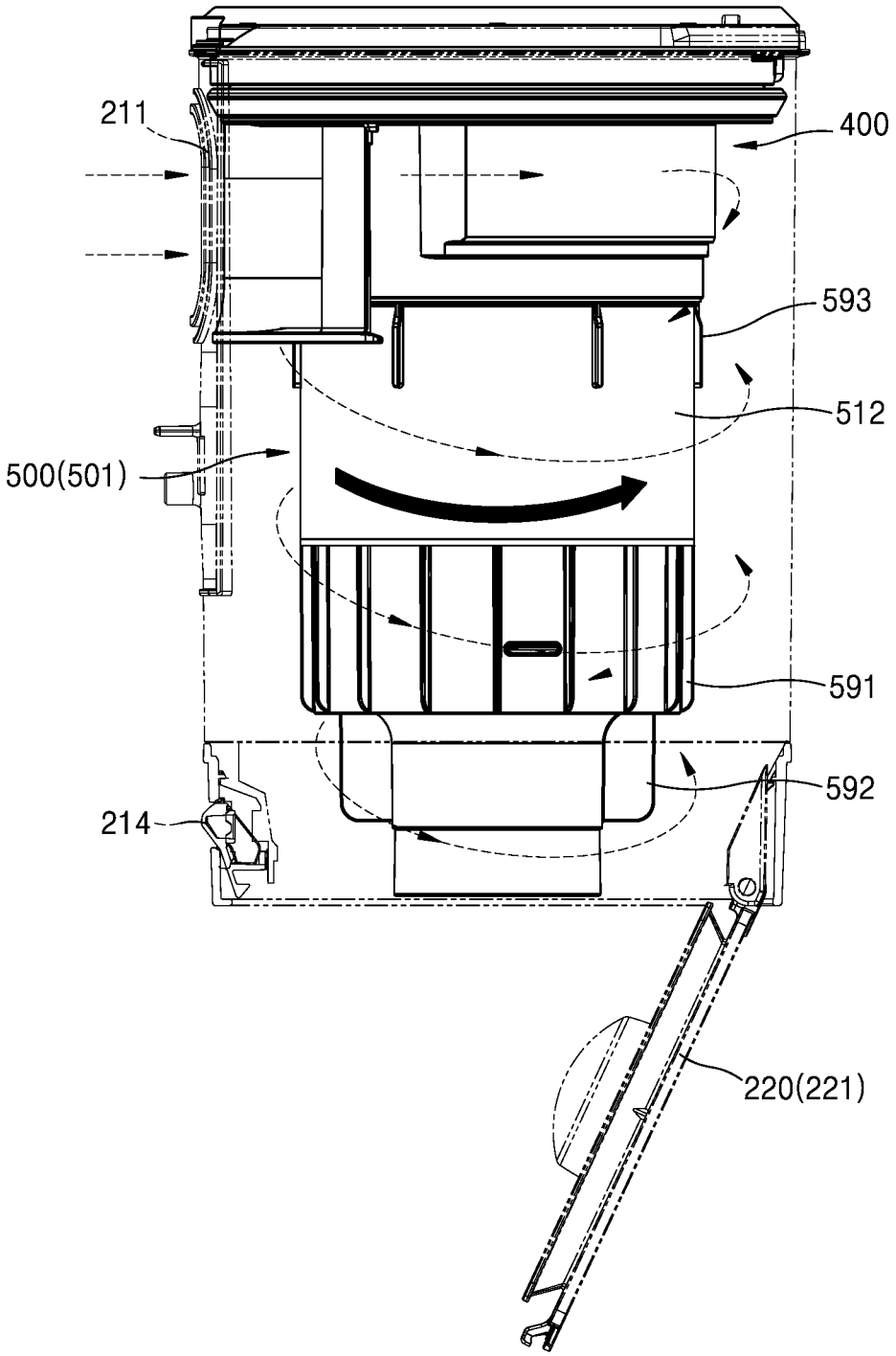
FIG. 20 is a view for explaining an operation of the rotating part of the cyclone module of FIG. 19.
Figure 21:
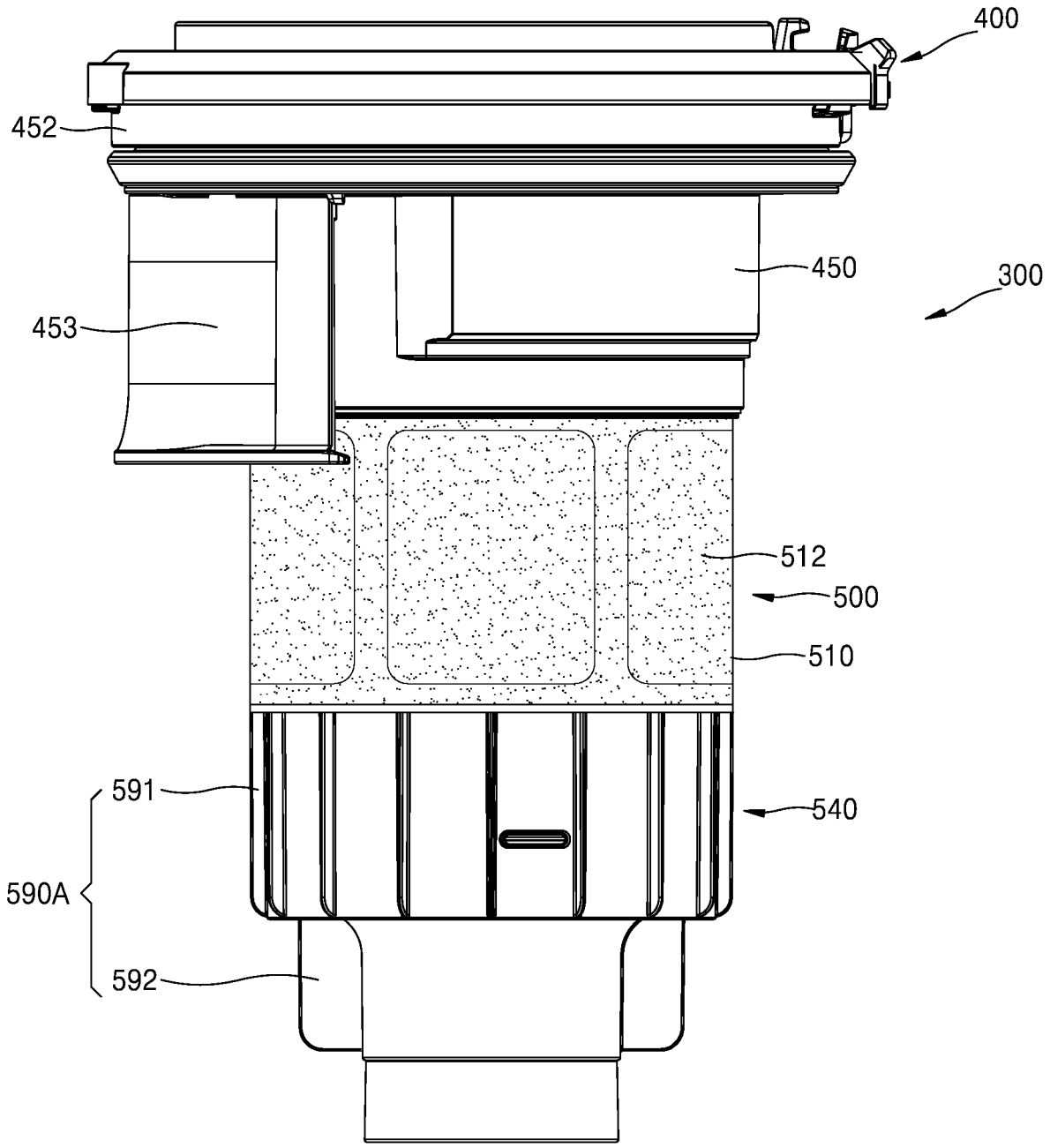
FIG. 21 is a front view of a cyclone module including a first rotation guide member according to an embodiment of the disclosure.
Figure 22:
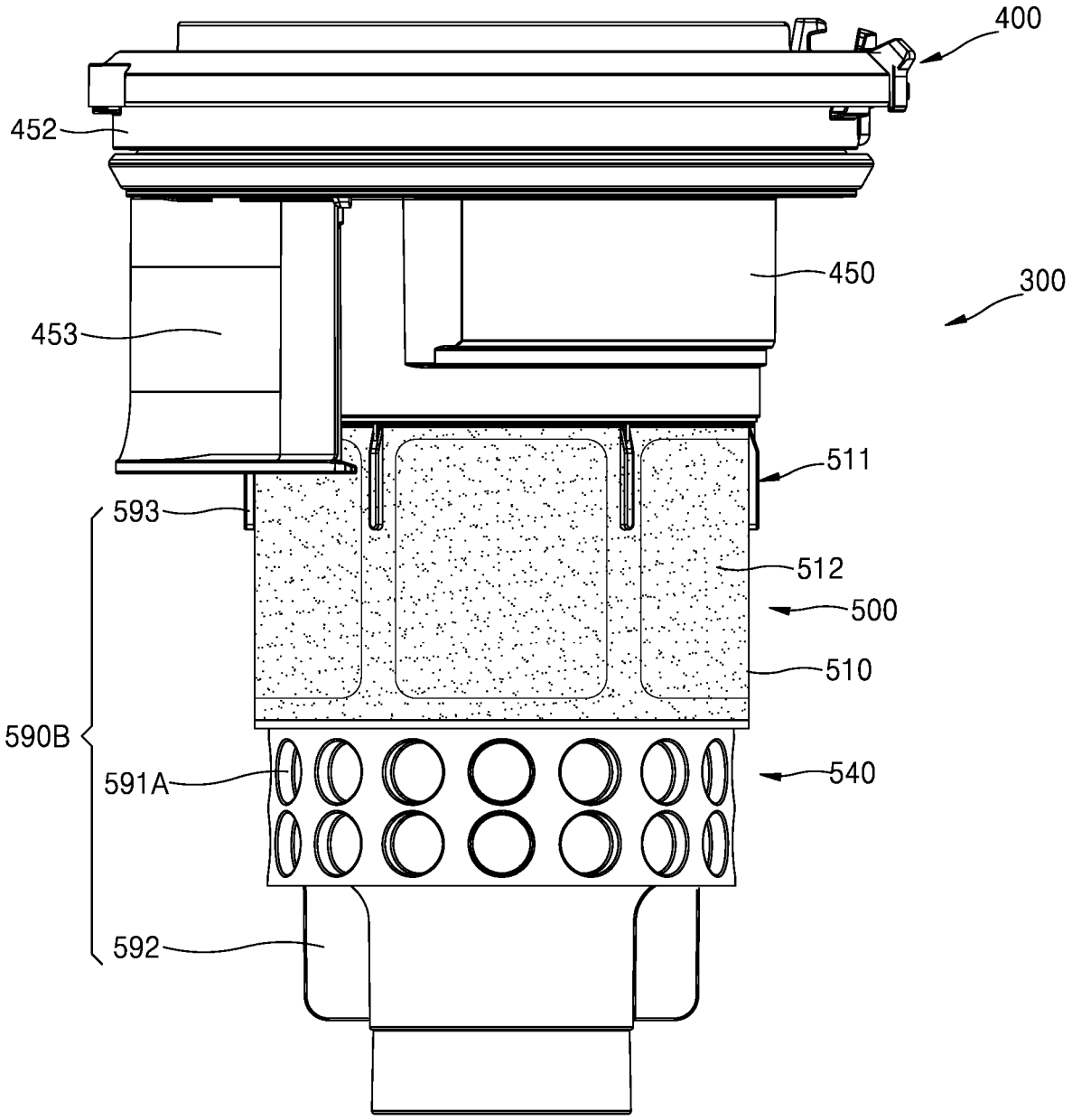
FIG. 22 is a front view of a cyclone module including a first rotation guide member according to another example.

FIG. 19 is a front view of the cyclone module 300 according to an embodiment of the disclosure, and FIG. 20 is a view for explaining an operation of the rotating part 500 of the cyclone module 300 of FIG. 19. FIGS. 21 and 22 are f views of the cyclone module 300 for describing an example in which a rotation guide member is modified.

Referring to FIGS. 19 and 20, as the discharge door 220 is switched from the closed position 222 to the open position 221, the rotating part 500 of the cyclone module 300 moves downward to be switched from the locked state 502 to the rotating state 501.

While in the rotating state 501, the rotating part 500 may be rotated by an airflow introduced into the dust collecting casing 210. The rotating part 500 may rotate at speed greater than or equal to 300 revolutions per minute (rpm) but less than or equal to 10,000 rpm. The rotating part 500 may include a rotation guide unit configured to be rotated by an airflow introduced via the air inlet 211.

Referring to FIG. 19, for example, the rotation guide unit may include a first rotation guide member 590 configured to receive a rotational force due to an airflow introduced via the air inlet 211. The first rotation guide member 590 may include a plurality of outer blades configured to rotate the rotating part 500 when pressed by a swirling airflow formed by the air drawn in through the air inlet 211. The plurality of outer blades may extend in a direction perpendicular to or oblique to a direction of movement of the air. For example, each of the plurality of outer blades may extend in a longitudinal direction.

The plurality of outer blades may be provided on the outer circumferential surface of the rotating part 500. For example, a plurality of outer blades may be provided on an outer circumferential surface of the dust separation member 520. The plurality of outer blades may be designed or provided so as not to degrade dust discharging performance.

For example, the plurality of outer blades may be provided under the mesh filter 512. The plurality of outer blades may include a plurality of first outer blades 591 provided on an outer circumferential surface of the support wall 540 and a plurality of second outer blades 592 provided on an outer circumferential surface of the dust storage 530.

The plurality of outer blades provided under the mesh filter 512 may be provided not to protrude more in a radial direction than the mesh filter 512, such that hair, etc., is not caught during a dust discharging process. For example, an outer diameter D2 formed by the plurality of first outer blades 591 may be less than or equal to an outer diameter D1 of the mesh filter 512. An outer diameter D3 formed by the plurality of second outer blades 592 may be less than or equal to the outer diameter D2 formed by the plurality of first outer blades 591.

The plurality of outer blades may further include a third outer blade 593 provided on an outer circumferential surface of the inner casing 510. The plurality of outer blades may further include the third outer blade 593 provided on an outer circumferential surface of the cyclone barrier 511. For example, the third outer blade 593 may be provided between the mesh filters 512. However, because the second and third outer blades 592 and 593 are optional components, they may be omitted when necessary. For example, as shown in FIG. 21, a rotation guide member 590A may include first and second outer blades 591 and 592 but may not include a third outer blade 593. For example, although not shown, the first rotation guide member 590 may include the first outer blades 591 and may not include the second and third outer blades 592 and 593.

The plurality of outer blades may be provided symmetrically about the rotation axis of the rotating part 500. Therefore, it is possible to prevent the occurrence of eccentricity due to asymmetrical arrangement of the outer blades during rotation of the rotating part 500.

The first rotation guide member 590 may have a rib shape protruding from a surface. However, the shape of the first rotation guide member 590 is merely an example, and the first rotation guide member 50 may be formed into various shapes as long as it has a structure for rotating the rotating part 500. For example, at least a portion of the first rotation guide member 590 may have a concave structure as a structure for increasing frictional resistance with air forming a swirling airflow. For example, as shown in FIG. 22, a first rotation guide member 590B may include concave members 591A having a groove or hole shape.

Figure 23:
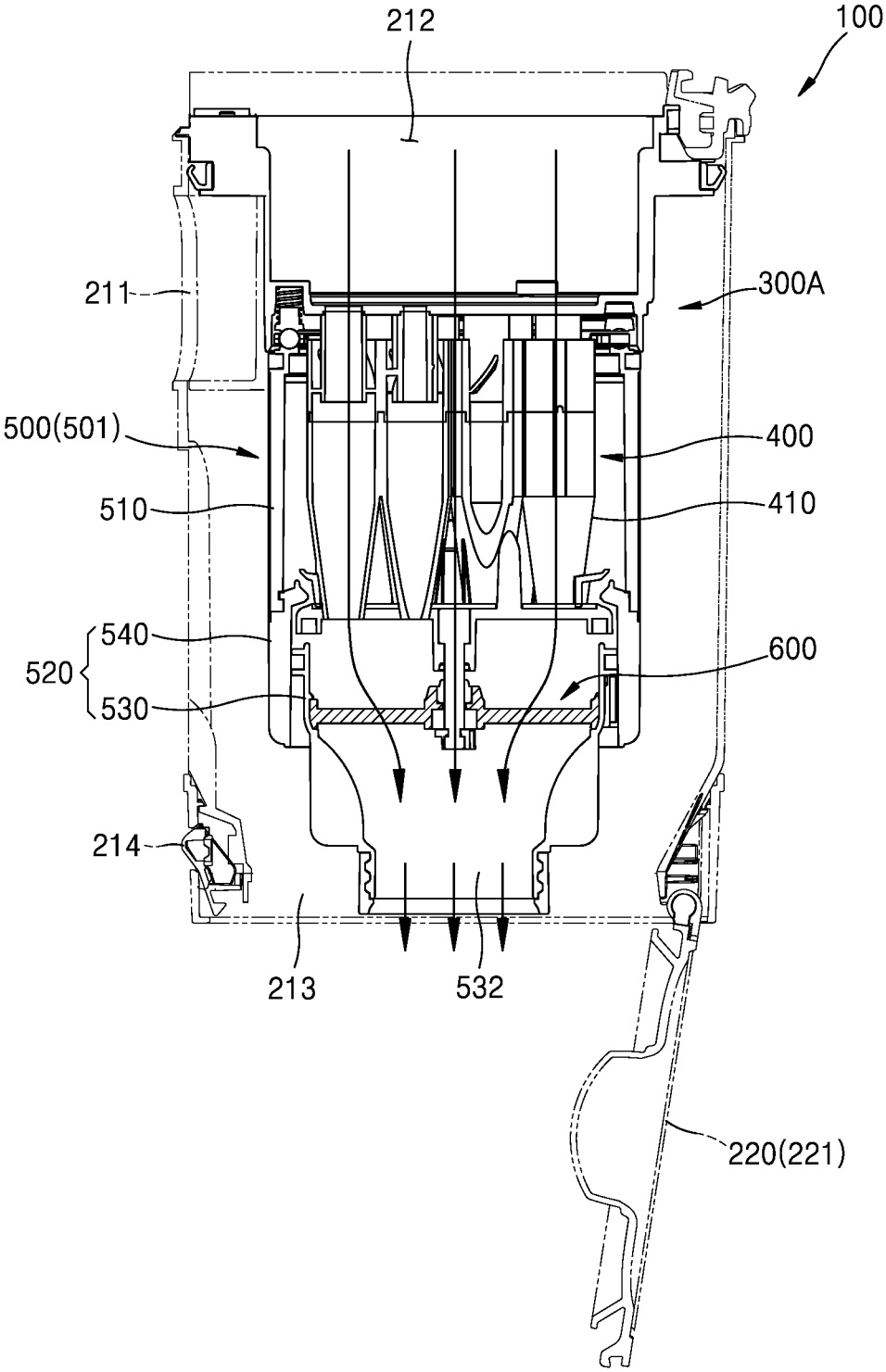
FIG. 23 is a cross-sectional view of a dust collector including a cyclone module according to an embodiment of the disclosure.
Figure 24:
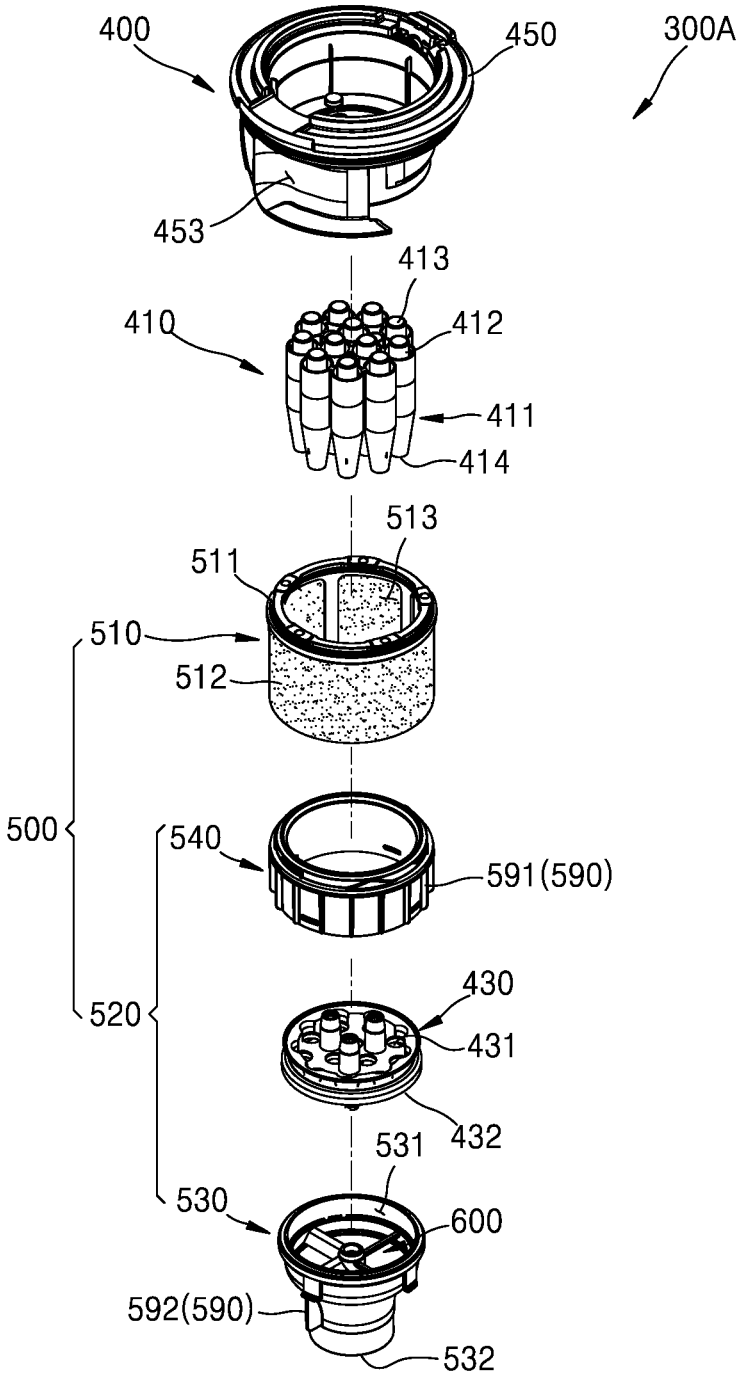
FIG. 24 is an exploded perspective view of a cyclone module according to an embodiment of the disclosure.
Figure 25:
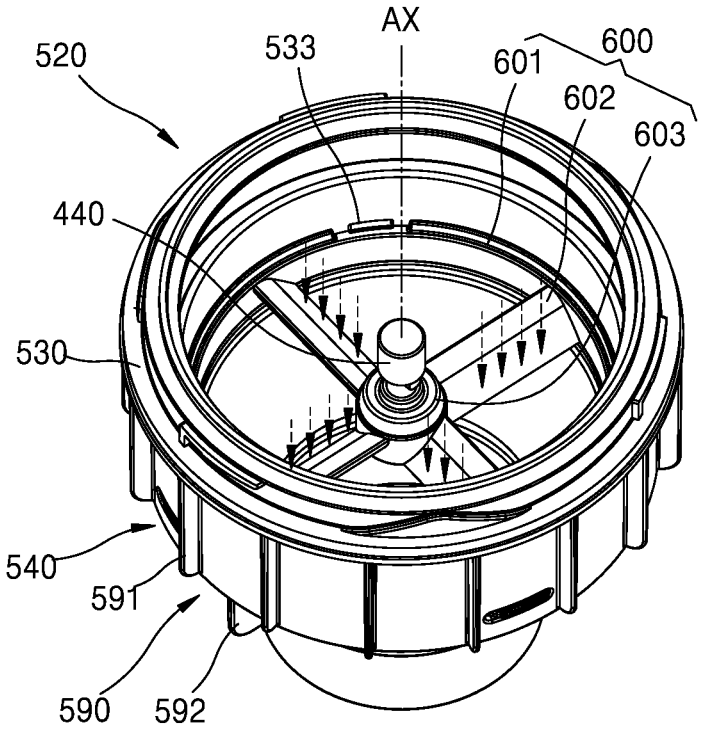
FIG. 25 is a view for explaining an example in which a second rotation guide member is provided inside a rotating part of FIG. 24.
Figure 26:
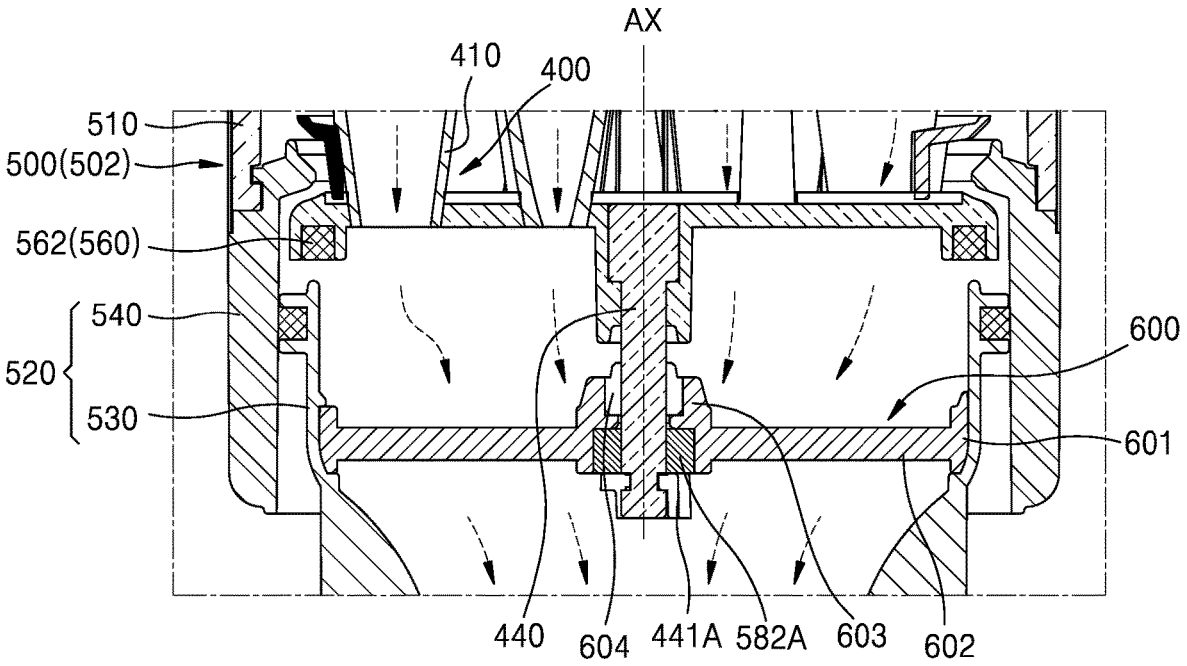
FIG. 26 is an enlarged cross-sectional view of a lower region of a rotating part of FIG. 23.

FIG. 23 is a cross-sectional view of a dust collector 100 including a cyclone module 300A according to an embodiment of the disclosure. FIG. 24 is an exploded perspective view of the cyclone module 300A according to an embodiment of the disclosure. FIG. 25 is a view for explaining an example in which a second rotation guide member 600 is provided inside the rotating part 500 of FIG. 24. FIG. 26 is an enlarged cross-sectional view of a lower region of the rotating part 500 of FIG. 23.

Referring to FIG. 23, when the rotating part 500 of the cyclone module 300A according to the embodiment of the disclosure is in the rotating state 501, air may be introduced into the dust collector 100 via the air inlet 211 as well as the air outlet 212. The air outlet 212 functions as a passage through which air is expelled when the discharge door 220 is in the closed position 222 while functioning as a passage through which air is introduced when the discharge door 220 is in the open position 221.

Referring to FIG. 24, to induce rotation of the rotating part 500, the cyclone module 300A according to the embodiment of the disclosure may include a first rotation guide member 590 configured to receive a rotational force due to an airflow introduced via the air inlet 211 and a second rotation guide member 600 configured to receive a rotational force due to an airflow introduced via the air outlet 212. Here, because the first rotation guide member 590 is substantially the same as that in the above-described embodiments of the disclosure, descriptions already provided above will be omitted.

The second rotation guide member 600 may be provided under the cyclone body 410. Accordingly, when the airflow introduced into the rotating part 500 via the air outlet 212 is discharged through the cyclone body 410, the second rotation guide member 600 may be rotated.

Referring to FIGS. 23 through 25, the second rotation guide member 600 may be provided inside the dust separation member 520. For example, the second rotation guide member 600 may be provided inside the dust storage 530.

The second rotation guide member 600 may have a turbine blade structure. The second rotation guide member 600 may include a coupling portion 601 coupled to the dust storage 530, a plurality of inner blades 602 extending inwardly from the coupling portion 601, and a rotation support 603 provided at a center of rotation of the inner blades 602.

The coupling portion 601 may have an outer diameter corresponding to the inner circumferential surface of the dust storage 530. The coupling portion 601 may have a ring shape. Movement of the coupling portion 601 in the longitudinal direction may be restricted by the coupling protrusion 533 provided on the inner circumferential surface of the dust storage 530.

The second rotation guide member 600 may be configured to receive a rotational force due to the airflow introduced via the air outlet 212. For example, the inner blades 602 may be configured to receive a rotational force due to the airflow introduced via the air outlet 212. The airflow introduced via the air outlet 212 moves toward the foreign substance discharge port 213 through the cyclone body 410.

Each of the inner blades 602 may have a certain inclination with respect to a rotation axis AX of the rotating part 500. For example, the inner blade 602 may have an inclination of 10 degrees to 80 degrees with respect to the rotation axis AX. For example, the inner blade 602 may have an inclination of 20 degrees to 70 degrees with respect to the rotation axis AX. For example, the inner blade 602 may have an inclination of 30 degrees to 60 degrees with respect to the rotation axis AX. The inner blade 602 may be inclined relative to a direction of movement of the air introduced via the air outlet 212. The inner blade 602 may be inclined relative to a direction of the air discharged through the foreign substance discharge port 213.

Referring to FIGS. 25 and 26, a second bearing structure 582A may be provided on the rotation support 603. The second rotation guide member 600 may be rotated relative to the rotation shaft 440 by the second bearing structure 582A. A rotation axis of the second rotation guide member 600 is coaxial with the rotation axis AX of the rotating part 500.

The rotation support 603 may further include a ring structure 604 supported by the rotation shaft 440 when the rotating part 500 rotates. The ring structure 604 may be spaced apart from the second bearing structure 582A in a direction of the rotation axis AX of the rotation shaft 440. The ring structure 604 may be provided above the second bearing structure 582A.

The ring structure 604 may include a material different from that of the rotation support 603. For example, when the rotation support 603 is made of a plastic material, the ring structure 604 may include a metal material. An inner circumferential surface of the ring structure 604 may have a constant inner diameter. The second bearing structure 582 and the ring structure 604 allow stable rotation of the rotating part 500. Although the ring structure 604 is used for stable rotation of the rotating part 500 in the embodiment of the disclosure, the disclosure is not necessarily limited thereto, and various modifications may be implemented. For example, as shown in FIG. 17, the first bearing structure 581A may be provided on the rotation support 603 instead of the ring structure 604.

Referring back to FIG. 23, as the second rotation guide member 600 as described above is provided inside the rotating part 500, the second rotation guide member 600 rotates while the air introduced via the air outlet 212 is moving toward the foreign substance discharge port 213, and the rotating part 500 in which the second rotation guide member 600 is provided rotates with respect to the fixed part 400.

Figure 27:
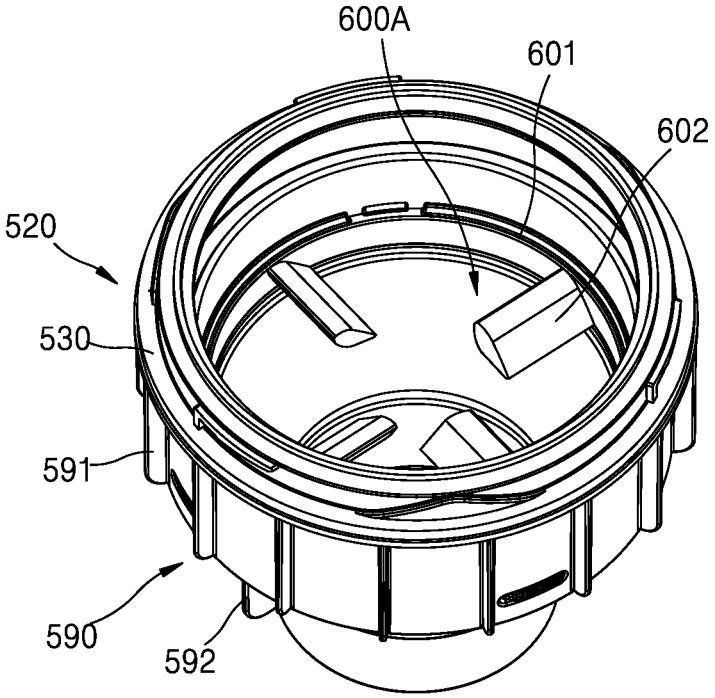
FIG. 27 is a perspective view for explaining a second rotation guide member according to an embodiment of the disclosure.

The above embodiment of the disclosure has been described mainly with respect to the second rotation guide member 600 with the inner blades 602 rotating around the rotation support 603. However, a shape of the second rotation guide member 600 is not limited thereto, and may be variously modified as long as the second rotation guide member 600 is configured to rotate due to the air introduced via the air outlet 212. For example, as shown in FIG. 27, a second rotation guide member 600A may have a structure in which the plurality of inner blades 602 protrude from the coupling portion 601 without the rotation support 603.

Figure 28:
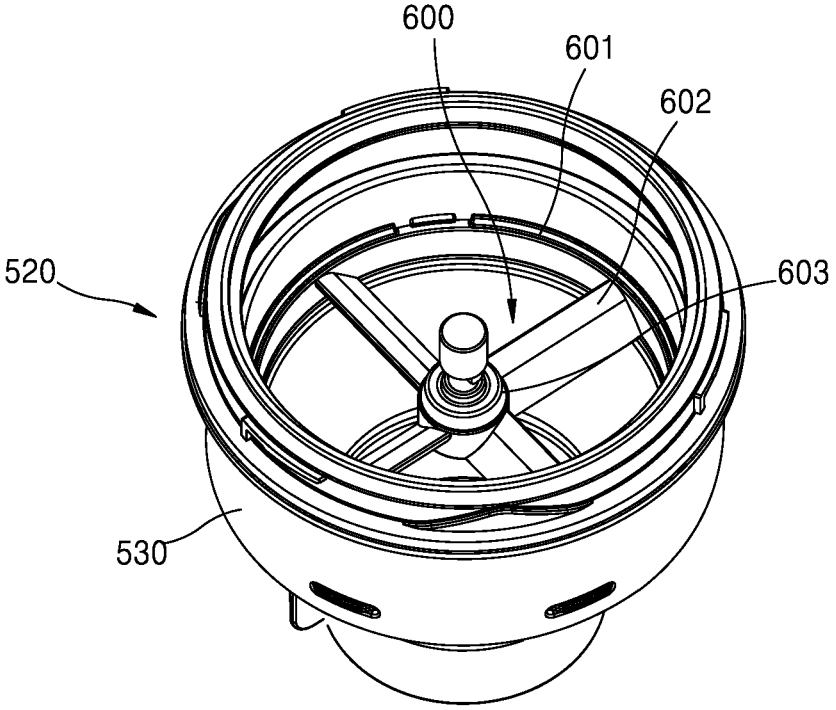
FIG. 28 is a perspective view for explaining a rotation guide unit according to an embodiment of the disclosure.

The above embodiment of the disclosure has been described with respect to the example in which the cyclone module 300 includes, as a configuration for rotating the rotating part 500 due to an airflow introduced into the dust collector 100, the first rotation guide member 590 provided on the outer circumferential surface of the rotating part 500 and the second rotation guide member 600 provided at the inner circumferential surface of the rotating part 500. However, the configuration for rotating the rotating part 500 of the cyclone module 300 (300A) is not limited thereto, and may be freely modified as long as the configuration includes at least one of the first rotation guide member 590 or the second rotation guide member 600. For example, as shown in FIG. 28, the rotating part 500 may include the second rotation guide member 600 provided at the inner circumferential surface thereof without the first rotation guide member 590. As another example, as shown in FIG. 3, the rotating part 500 may include the first rotation guide member 590 provided on the outer circumferential surface without the second rotation guide member 600.

Figure 29:
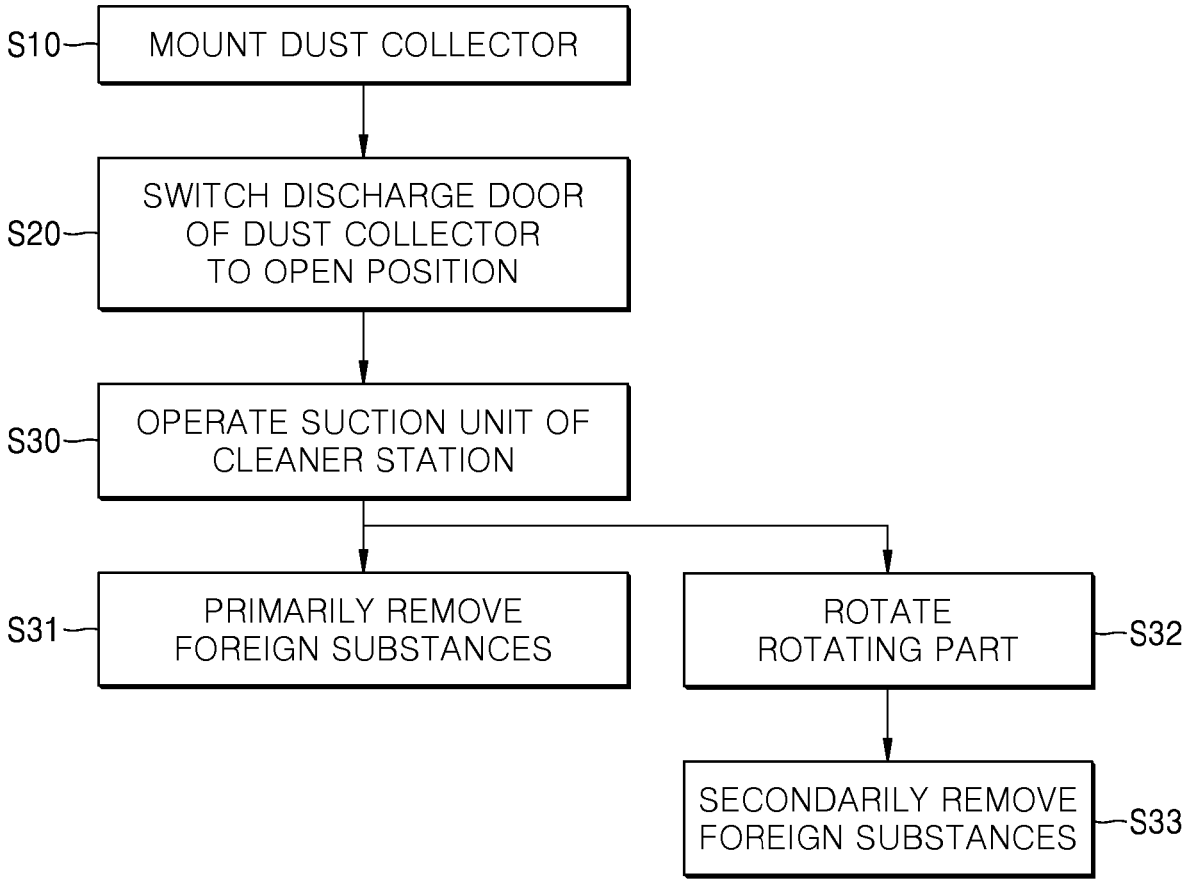
FIG. 29 is a flowchart for explaining a process of discharging foreign substances collected in a dust collector from a cleaning device, according to an embodiment of the disclosure.

FIG. 29 is a flowchart for explaining a process of discharging foreign substances collected in the dust collector 100 from the cleaning device 1, according to an embodiment of the disclosure.

Referring to FIGS. 5 and 29, first, a user places the dust collector 100 of the vacuum cleaner 10 on the cleaner station 2 before or after using the vacuum cleaner 10 (S10). The user docks the dust collector 100 with the discharge door 220 facing down onto the docking part 3 of the cleaner station 2.

While the dust collector 100 is mounted to the cleaner station 2, the door lock member 214 of the dust collector 100 is pressed by the opening guide 32 of the cleaner station 2. As the door lock member 214 is pressed, the end 2201 of the discharge door 220 is decoupled from the door lock member 214, so that the discharge door 220 is switched from the closed position 222 to the open position 221 (S20).

As the discharge door 220 is switched to the open position 221, the dust collector 100 is connected to the collector 5 via the suction flow path 6. At this time, in the cyclone module 300 of the dust collector 100, the rotating part 500 moves downward due to gravity acting on the rotating part 500 itself and a force applied by the pressure member 480 of the rotating part 500 and is switched to the rotating state 501 so that it is rotatable with respect to the fixed part 400.

In this state, the suction unit 4 of the cleaner station 2 operates (S30). When the suction unit 4 rotates the suction fan 42, a suction force is provided to the dust collector 100. Air is introduced via the air inlet 211 and the air outlet 212 due to the provided suction force, and the introduced air is discharged through the foreign substance discharge port 213.

As shown in FIG. 20, the air introduced via the air inlet 211 forms a swirling airflow along the flow guide 453 of the fixed part 400. In the first cyclone 101, the air introduced via the air inlet 211 forms a swirling airflow that moves obliquely relative to a horizontal direction. The air introduced via the air inlet 211 may move between the inner circumferential surface of the dust collecting casing 210 and the outer circumferential surface of the cyclone module 300 at an angle of 6 degrees to 12 degrees with respect to the horizontal direction. The air introduced via the air outlet 212 passes through the second cyclone 102 down to the foreign substance discharge port 213.

The flow of air moving toward the foreign substance discharge port 213 is generated in the dust collector 100 due to the suction force provided by the cleaner station 2. Accordingly, foreign substances collected in the dust collector 100 is primarily removed (S31).

The flow of air generated in the dust collector 100 may rotate the rotating part 500. In other words, the flow of air generated in the dust collector 100 may not only primarily remove the foreign substances (S31) but also rotate the rotating part 500 (S32).

For example, as described with reference to FIG. 20, the first rotation guide member 590 is pressed by the air forming the swirling airflow to rotate the rotating part 500. The rotating part 500 may have a rotational speed of a certain magnitude so that foreign substances remaining inside the dust collector 100 may be removed. For example, the rotational speed of the rotating part 500 may be greater than or equal to 300 rpm. For example, the rotational speed of the rotating part 500 may be greater than or equal to 500 rpm. The rotation speed of the rotating part 500 may be less than or equal to 10,000 rpm.

In order to achieve the rotation speed of the rotating part 500, referring to FIG. 5, the cleaner station 2 may provide a certain suction force to the dust collector 100. For example, the suction unit 4 of the cleaner station 2 may provide a suction force so that the rotating part 500 rotates at speed greater than or equal to 300 rpm but less than or equal to 10,000 rpm. To achieve the rotation speed of the rotating part 500, the suction unit 4 may control a suction force so that movement velocity of the swirling airflow created in the dust collector 100 is in a certain range, e.g., in a range from 10 m/s to 50 m/s.

As the rotating part 500 rotates, foreign substances in the dust collector 100 may be secondarily removed (S33). In other words, as the rotating part 500 rotates, foreign substances adhering to a surface of the cyclone module 300 may be separated from the surface of the cyclone module 300 due to a centrifugal force and a rotation torque of the rotating part 500. The separated foreign substances are discharged through the foreign substance discharge port 213 due to the suction force provided by the cleaner station 2. Thus, it is possible to reduce the amount of foreign substances remaining inside the dust collector 100 in the process of discharging the foreign substances.

Unlike in the embodiment of the disclosure, when the dust collector 100 has a structure in which foreign substances are removed using only the suction force provided by the cleaner station 2 without rotation of the rotating part 500, some of the foreign substances collected in the dust collecting casing 210 may adhere to the surface of the cyclone module 300 and remain therein without being discharged. For example, because foreign substances such as hair, etc. are caught or wound in an assembly gap of the cyclone module 300 or the mesh filter 512, the foreign substances may not be completely removed from the dust collector by using only the suction force provided by the cleaner station 2 but remain inside the dust collector 100.

On the other hand, in the cleaning device 1 according to the embodiment of the disclosure, as the rotating part 500, which is a part of the cyclone module 300, rotates, an external force due to the rotating part 500 may be applied to the foreign substances remaining in the dust collector 100 to thereby minimize the amount of foreign substances remaining in the dust collector 100 in the process of discharging the foreign substances. A dust collector, a vacuum cleaner including the dust collector, and a cleaning device including the vacuum cleaner according to the embodiments of the disclosure may minimize the amount of foreign substances remaining in the dust collector, thereby improving user convenience.

According to an embodiment of the disclosure, a dust collector may include: a dust collecting casing including an air inlet via which air is drawn in from outside, an air outlet via which air from which foreign substances are separated is discharged, and a foreign substance discharge port for discharging foreign substances collected therein; a cyclone module provided inside the dust collecting casing and configured to separate foreign substances by inducing a swirling flow of the air drawn in via the air inlet; and a discharge door movable between an open position for opening the foreign substance discharge port and a closed position for closing the foreign substance discharge port, wherein the cyclone module includes: a fixed part assembled to be fixed to the dust collecting casing; and a rotating part having a rotating state in which it is allowed to rotate with respect to the fixed part when the discharge door is in the open position and a locked state in which it is prevented from rotating with respect to the fixed part when the discharge door is in the closed position.

When the discharge door is switched from the closed position to the open position, the rotating part may move downward to be switched from the locked state to the rotating state, and when the discharge door is switched from the open position to the closed position, the rotating part may move upward to be switched from the rotating state to the locked state.

The dust collector may further include a rotation preventing member configured to provide, when the rotating part is in the locked state, a rotational friction force between the rotating part and the fixed part so as to prevent the rotating part from rotating with respect to the fixed part.

The rotation preventing member may be elastically deformable, and may include an elastic member provided on at least one of the rotating part or the fixed part.

When the discharge door is in the closed position, the discharge door may contact and press the rotating part, and the rotation preventing member may be compressively deformed by the rotating part.

When the discharge door is in the open position, the discharge door is spaced apart from the rotating part, compressive deformation of the rotation preventing member by the rotating part is released, and the rotating part is rotatable with respect to the fixed part.

When the discharge door is in the open position, airflows may be introduced via the air inlet and the air outlet, foreign substances separated by the cyclone module may be discharged through the foreign substance discharge port, and the rotating part may include a rotation guide unit configured to receive a rotational force due to the airflows introduced via the air inlet and the air outlet.

The rotation guide unit may include a first rotation guide member provided on an outer circumferential surface of the rotating part to receive a rotational force due to the airflow introduced through the air inlet.

The rotation guide unit may further include a second rotation guide member provided at an inner circumferential surface of the rotating part to receive a rotational force due to air introduced via the air outlet.

The fixed part may include a cyclone body and a mounting member that supports the cyclone body and is mounted on the dust collecting casing, and the rotating part may include an inner casing having a cylindrical shape surrounding the cyclone body and including a mesh filter and a dust separation member assembled to the inner casing and having a dust collecting chamber in which dust separated from the cyclone body is collected.

The dust separation member may include a dust storage forming the dust collecting chamber and a support wall surrounding and supporting the dust storage, and the first rotation guide member may include a plurality of first outer blades provided on an outer circumferential surface of the support wall.

An outer diameter formed by the plurality of first outer blades may be less than or equal to an outer diameter of the mesh filter.

The first rotation guide member may further include a plurality of second outer blades provided on an outer circumferential surface of the dust storage, and an outer diameter formed by the plurality of second outer blades may be less than or equal to the outer diameter formed by the plurality of first outer blades.

The second rotation guide member may include an inner blade provided at an inner circumferential surface of the dust separation member.

The cyclone module may include at least one bearing structure for rotatably supporting the rotating part with respect to the fixed part, and the at least one bearing structure may be provided at a center of rotation of the inner blade.

The cyclone module may further include a pressure member for pressing the rotating part so that the rotating part is switched from the locked state to the rotating state.

The fixed part may include a stopper for limiting a position to which the rotating part is permitted to move downward.

According to an embodiment of the disclosure, a vacuum cleaner may include the dust collector described above.

According to an embodiment of the disclosure, a cleaning device may include: the vacuum cleaner having the dust collector described above; and a cleaner station including a docking part to which the dust collector is connectable, a suction unit providing a suction force so that foreign substances collected in the dust collector are discharged, and a collector for collecting the discharged foreign substances, wherein the suction unit may provide the suction force to the dust collector so that the rotating part of the dust collector rotates at speed greater than or equal to 300 rpm but less than or equal to 10,000 rpm.

According to an embodiment of the disclosure, a cleaner station may include a docking part to which the dust collector is connectable, a suction unit providing a suction force so that foreign substances collected in the dust collector are discharged, and a collector for collecting the discharged foreign substances, wherein the suction unit may provide the suction force to the dust collector so that the rotating part of the dust collector rotates at speed greater than or equal to 300 rpm but less than or equal to 10,000 rpm.

Although reference has been made to embodiments of the disclosure illustrated in the drawings for understanding the disclosure, and specific terms have been used to describe the embodiments thereof, the scope of the disclosure is not limited by the specific terms, and the disclosure will be construed to encompass all embodiments that would normally occur to one of ordinary skill in the art.

Particular implementations described herein merely correspond to embodiments of the disclosure and do not limit the scope of the disclosure in any way. For the sake of brevity of the specification, conventional electronic configurations, control systems, software, and other functional aspects of the systems may be omitted. Furthermore, connecting lines or connectors shown in various figures are intended to represent exemplary functional connections and/or physical or circuit couplings between components in the figures, and in an actual device, connections between components may be represented by many alternative or additional functional relationships, physical connections, or logical connections. In addition, an element may not be necessarily essential to the practice of the disclosure unless the element is specifically described as essential," "critical," etc. As used herein, the term such as "comprising", "including" and the like are used to be understood as being an open-ended term for describing embodiments of the disclosure.

The use of the terms "the" and similar referents in the context of describing the disclosure (especially in the context of the following claims) are to be construed to cover both the singular and the plural. Furthermore, recitation of ranges of values herein are merely intended to serve as a shorthand method of referring individually to each separate value falling within the range (unless otherwise indicated herein), and each separate value is incorporated into the specification as if it were individually recited herein. Lastly, operations of methods according to the disclosure described herein may be performed in any suitable order unless clearly specified herein or contradicted by context. The disclosure is not limited to the described order of the operations. The use of any and all examples or exemplary language, e.g., "such as", etc., provided herein is merely intended to describe the disclosure in detail and does not pose a limitation on the scope of the disclosure unless otherwise limited by the claims. Furthermore, various changes and modifications will be readily apparent to one of ordinary skill in the art without departing from the spirit and scope of the disclosure.

What is claimed is:

1. A dust collector comprising:

a dust collecting casing including an air inlet, an air outlet, and a foreign substance discharge port;

a cyclone module inside the dust collecting casing, wherein the dust collecting casing and the cyclone module are configured so that air and foreign substances are drawn into the dust collecting casing through the air inlet, the foreign substances drawn into the dust collecting casing are separated from the air drawn into the dust collecting casing by the cyclone module, the separated foreign substances are dischargeable from the dust collecting casing through the foreign substance discharge port, and the air from which the foreign substances are separated is expelled through the air outlet; and a discharge door configured to be switchable between an open position in which the foreign substance discharge port is opened and a closed position in which the foreign substance discharge port is closed, wherein the cyclone module includes:

a fixed part fixed to the dust collecting casing, a rotating part, and at least one bearing structure rotatably supporting the rotating part with respect to the fixed part, and the dust collecting casing, the cyclone module, and the discharge door are configured so that, when the discharge door is in the open position, the rotating part is in a rotating state in which the rotating part is rotatable with respect to the fixed part via the at least one bearing structure and air flow generated in the dust collecting casing, and rotation of the rotating part with respect to the fixed part via the at least one bearing structure and the air flow causes foreign substances adhering to a surface of the cyclone module to be separated from the surface of the cyclone module and then discharged through the foreign substance discharge port, and, when the discharge door is in the closed position, the rotating part is in a locked state in which the rotating part is prevented from rotating with respect to the fixed part.

2. The dust collector of claim 1, wherein, when the discharge door is switched from the closed position to the open position, the rotating part moves downward to be switched from the locked state to the rotating state, and when the discharge door is switched from the open position to the closed position, the rotating part moves upward to be switched from the rotating state to the locked state.

3. The dust collector of claim 2, wherein the fixed part includes a stopper configured to limit a position to which the rotating part is permitted to move downward.

4. The dust collector of claim 1, further comprising:

a rotation preventing member configured to provide, when the rotating part is in the locked state, a rotational friction force between the rotating part and the fixed part so as to prevent the rotating part from rotating with respect to the fixed part.

5. The dust collector of claim 4, wherein the rotation preventing member is elastically deformable and includes an elastic member on at least one of the rotating part or the fixed part.

6. The dust collector of claim 5, wherein when the discharge door is in the closed position, the discharge door contacts and presses the rotating part, and the rotation preventing member is compressively deformed by the rotating part.

7. The dust collector of claim 6, wherein when the discharge door is in the open position, the discharge door is spaced apart from the rotating part, compressive deformation of the rotation preventing member by the rotating part is released, and the rotating part is rotatable with respect to the fixed part.

8. The dust collector of claim 1, wherein when the discharge door is in the open position, airflows are introduceable into the dust collecting casing via the air inlet and the air outlet, and the foreign substances separated from the air are dischargeable through the foreign substance discharge port, and the rotating part includes a rotation guide unit configured to receive a rotational force due to the airflows introduced via the air inlet and the air outlet.

9. The dust collector of claim 8, wherein the rotation guide unit includes a first rotation guide member on an outer circumferential surface of the rotating part to receive a rotational force due to the airflows introduced through the air inlet.

10. The dust collector of claim 9, wherein the rotation guide unit further includes a second rotation guide member at an inner circumferential surface of the rotating part to receive a rotational force due to the airflows introduced via the air outlet.

11. The dust collector of claim 10, wherein the fixed part includes a cyclone body, and a mounting member supporting the cyclone body and mounted on the dust collecting casing, and the rotating part includes an inner casing having a cylindrical shape surrounding the cyclone body and including a mesh filter and a dust separation member assembled to the inner casing and having a dust collecting chamber in which the foreign substances separated from the air are collected.

12. The dust collector of claim 11, wherein the dust separation member includes a dust storage forming the dust collecting chamber and a support wall surrounding and supporting the dust storage, and the first rotation guide member includes a plurality of first outer blades on an outer circumferential surface of the support wall.

13. The dust collector of claim 12, wherein an outer diameter formed by the plurality of first outer blades is less than or equal to an outer diameter of the mesh filter.

14. The dust collector of claim 12, wherein the first rotation guide member further includes a plurality of second outer blades on an outer circumferential surface of the dust storage, and an outer diameter formed by the plurality of second outer blades is less than or equal to the outer diameter formed by the plurality of first outer blades.

15. The dust collector of claim 11, wherein the second rotation guide member includes an inner blade at an inner circumferential surface of the dust separation member.

16. The dust collector of claim 15, wherein the at least one bearing structure is at a center of rotation of the inner blade.

17. The dust collector of claim 1, wherein the cyclone module further includes a pressure member configured to press the rotating part so that the rotating part is switched from the locked state to the rotating state.

18. A vacuum cleaner including the dust collector of claim 1.

19. The dust collector of claim 1, wherein each bearing structure of the at least one bearing structure is a ball bearing or a roller bearing.

20. A cleaning device comprising:

a vacuum cleaner including:

a dust collecting casing including an air inlet, an air outlet, and a foreign substance discharge port, a cyclone module inside the dust collecting casing, wherein the dust collecting casing and the cyclone module are configured so that air and foreign substances are drawn into the dust collecting casing through the air inlet, the foreign substances drawn into the dust collecting casing are separated from the air drawn into the dust collecting casing by the cyclone module, the separated foreign substances are dischargeable from the dust collecting casing through the foreign substance discharge port, and the air from which the foreign substances are separated is expelled through the air outlet, and a discharge door configured to be switchable between an open position in which the foreign substance discharge port is opened and a closed position in which the foreign substance discharge port is closed, wherein the cyclone module includes:

a fixed part fixed to the dust collecting casing, a rotating part, and at least one bearing structure rotatably supporting the rotating part with respect to the fixed part, and the dust collecting casing, the cyclone module, and the discharge door are configured so that, when the discharge door is in the open position, the rotating part is in a rotating state in which the rotating part is rotatable with respect to the fixed part via the at least one bearing structure and air flow generated in the dust collecting casing, and rotation of the rotating part via the at least one bearing structure and the air flow causes foreign substances adhering to a surface of the cyclone module to be separated from the surface of the cyclone module and then discharged through the foreign substance discharge port, and, when the discharge door is in the closed position, the rotating part is in a locked state in which the rotating part is prevented from rotating with respect to the fixed part; and a cleaner station including:

a docking part to which the vacuum cleaner is connectable, a suction unit configured to provide a suction force to generate the air flow in the dust collecting casing to rotate the rotating part when the vacuum cleaner is connected to the docking part, the discharge door is in the open position, and the rotating part is in the rotating state, so that the foreign substances separated from the air and the foreign substances separated from the surface of the cyclone module in the dust collecting casing are discharged through the foreign substance discharge port to the cleaner station, and a collector configured to collect the foreign substances discharged to the cleaner station.

* * * * *